US008784288B2

(12) United States Patent
Mate' et al.

(10) Patent No.: US 8,784,288 B2
(45) Date of Patent: Jul. 22, 2014

(54) PIZZA TRAY AND FORMING ASSEMBLY

(75) Inventors: Matthew Mark Mate', Forest Lake, MN (US); Thomas Murdock Partridge, Eagan, MN (US); David Lee Belden, Wyoming, MN (US)

(73) Assignee: Delkor Systems, Inc., St. Paul, MN (US)

( * ) Notice: Subject to any disclaimer, the term of this patent is extended or adjusted under 35 U.S.C. 154(b) by 540 days.

(21) Appl. No.: 13/167,560

(22) Filed: Jun. 23, 2011

(65) Prior Publication Data

US 2011/0319241 A1 Dec. 29, 2011

Related U.S. Application Data

(60) Provisional application No. 61/357,944, filed on Jun. 23, 2010.

(51) Int. Cl.
*B31B 1/00* (2006.01)

(52) U.S. Cl.
CPC ..... *B31B 1/00* (2013.01); *B31B 2203/068* (2013.01); *B31B 2201/2604* (2013.01); *B31B 2201/94* (2013.01)
USPC ..... 493/52; 493/51; 493/152; 493/162; 493/163; 493/167

(58) Field of Classification Search
USPC ..... 493/51, 52, 69, 79, 104, 105, 109, 152, 493/153, 162, 163, 167, 175, 183; 53/376.8, 377.5, 382.2, 382.3
See application file for complete search history.

(56) References Cited

U.S. PATENT DOCUMENTS

| | | | | |
|---|---|---|---|---|
| 2,483,063 | A * | 9/1949 | Ray | 493/137 |
| 2,599,008 | A | 6/1952 | Palmer | |
| 3,149,544 | A * | 9/1964 | Govatsos | 493/137 |
| 3,492,923 | A * | 2/1970 | Stenberg | 493/167 |
| 3,593,623 | A * | 7/1971 | Oakley | 493/167 |
| 3,638,537 | A * | 2/1972 | Cato | 493/167 |
| 6,946,082 | B1 | 9/2005 | Watkins | |
| 7,525,075 | B1 | 4/2009 | Watkins | |

* cited by examiner

*Primary Examiner* — Thanh Truong
*Assistant Examiner* — Eduardo R Ferrero
(74) *Attorney, Agent, or Firm* — Vidas, Arrett & Steinkraus, P.A.

(57) ABSTRACT

A forming assembly and process for forming a carton from a carton blank are herein disclosed. The finished carton can have an odd number of sides and/or an angle between two adjacent sides that is less than 90 degrees. The forming assembly includes a forming head and a forming cavity. The forming head acts as an inner die and the forming cavity acts as an outer die. In addition, the forming cavity includes at least one cavity side plate that desirably folds tabs on the carton blank to secure the tabs to one another and form the finished carton.

6 Claims, 31 Drawing Sheets

PIZZA TRAY AND FORMING ASSEMBLY

CROSS-REFERENCE TO RELATED APPLICATIONS

This Application claims priority to Provisional Application No. 61/357,944, filed Jun. 23, 2010, the contents of which are herein incorporated by reference.

STATEMENT REGARDING FEDERALLY SPONSORED RESEARCH

None.

BACKGROUND OF THE INVENTION (1) Field of the Invention

In at least one embodiment, the present invention relates generally to an apparatus for forming a carton, and more specifically it relates to a machine and method for assembling a multi-edged carton from a carton blank.

(2) Description of Related Art

Carton assembling machines of various varieties are known in the art. Carton blanks have been formed into cartons that are cuboid in shape, such that the carton has sides which are orthogonal to one another. In the case of a carton having orthogonal sides, the carton blank (which is generally a flat sheet prior to folding) can undergo an operation or series of operations to form the carton. More particularly, the carton blank is folded to create the sides of the carton, which are fastened together. Moreover, in forming a cuboid carton, the carton blank is folded at least one carton side at a time. The entire length of the side is folded simultaneously.

The operations used in forming cuboid cartons are ill-suited for forming cartons having sides which are not orthogonal with one another. In addition, folding the carton blank an entire side at a time is unsuitable for forming a carton having an odd number of fastened sides, a carton having two adjacent sides which are separated by less than 90 degrees, or other non-cuboid shaped cartons.

Therefore, there remains a need for a carton forming apparatus that is capable of quickly and efficiently forming a carton having sides that are separated by less than 90 degrees.

BRIEF SUMMARY OF THE INVENTION

In at least one embodiment, the invention is directed to a carton forming assembly for forming a carton having a plurality of sides, wherein at least two of the sides are separated by an angle less than 90 degrees. The forming assembly comprises a forming head and a forming cavity. The forming head comprises a plurality of forming head side plates and the forming cavity comprises a plurality of cavity side plates. In some embodiments, at least two of the cavity side plates and two of the forming head side plates are separated by an angle that is less than 90 degrees. In some embodiments, at least one of the cavity side plates has a forming surface and a raised surface, the raised surface extends along a portion of the forming surface, but does not extend the entire length of the cavity side plate.

In at least one embodiment, the carton forming assembly is particularly suited to form a carton having three major sides and a base. In this regard, the forming head may have two forming head side plates and a forming head back plate, each of the forming head side plates and forming head back plate corresponding to a side of the carton. Moreover, where the carton forming assembly is particularly suited to form a carton having three major sides and a base, the cavity can have two adjacent cavity side plates and a cavity back plate, the orientation of the cavity side plates and cavity back plate corresponding to the orientation of the forming head side plates and back plate. In some embodiments, the forming head is limited to three adjacent forming head plates (e.g., two side plates and one back plate) and the cavity is limited to three adjacent cavity plates (two side plates and a back plate). Advantageously, the carton forming assembly will be well suited to form triangular cartons which can be used as packaging for individual pizza slices, for example. Moreover, in some embodiments, the cartons will be microwaveable.

BRIEF DESCRIPTION OF THE SEVERAL VIEWS OF THE DRAWING(S)

FIG. 1 shows an embodiment of the forming assembly.

FIGS. 2A-2C shown a plurality of the forming assemblies of FIG. 1 along with a conjoining frame.

Figure 5A:
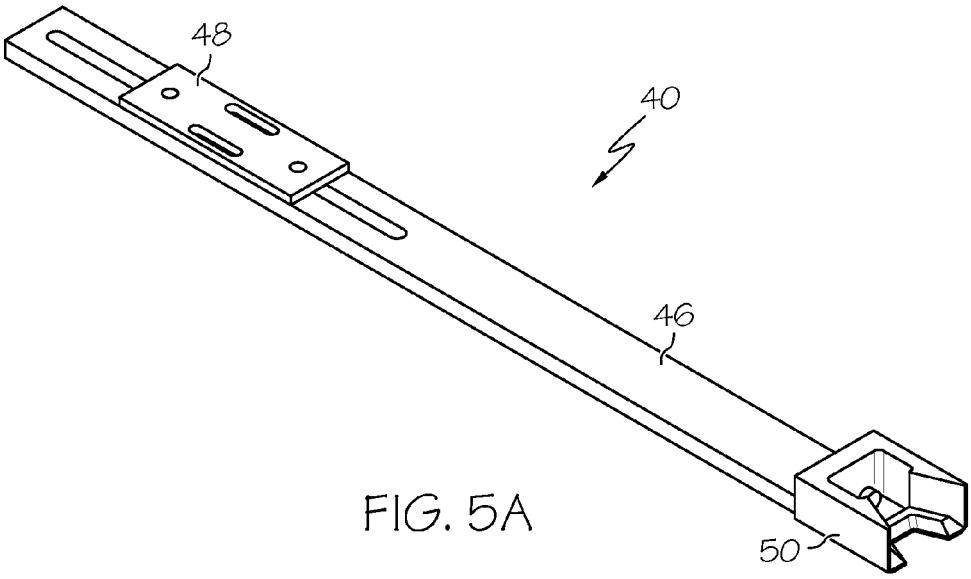
FIG. 5A shows an embodiment of the shuttle 40.
Figure 5B:
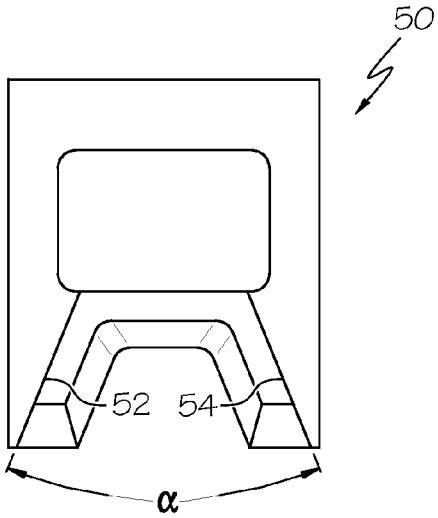
FIG. 5B shows an embodiment of the pusher 50 from FIG. 5A.

FIB. 5C shows a perspective view of the embodiment of the pusher 50 of FIGS. 5A and 5B.

Figure 6A:
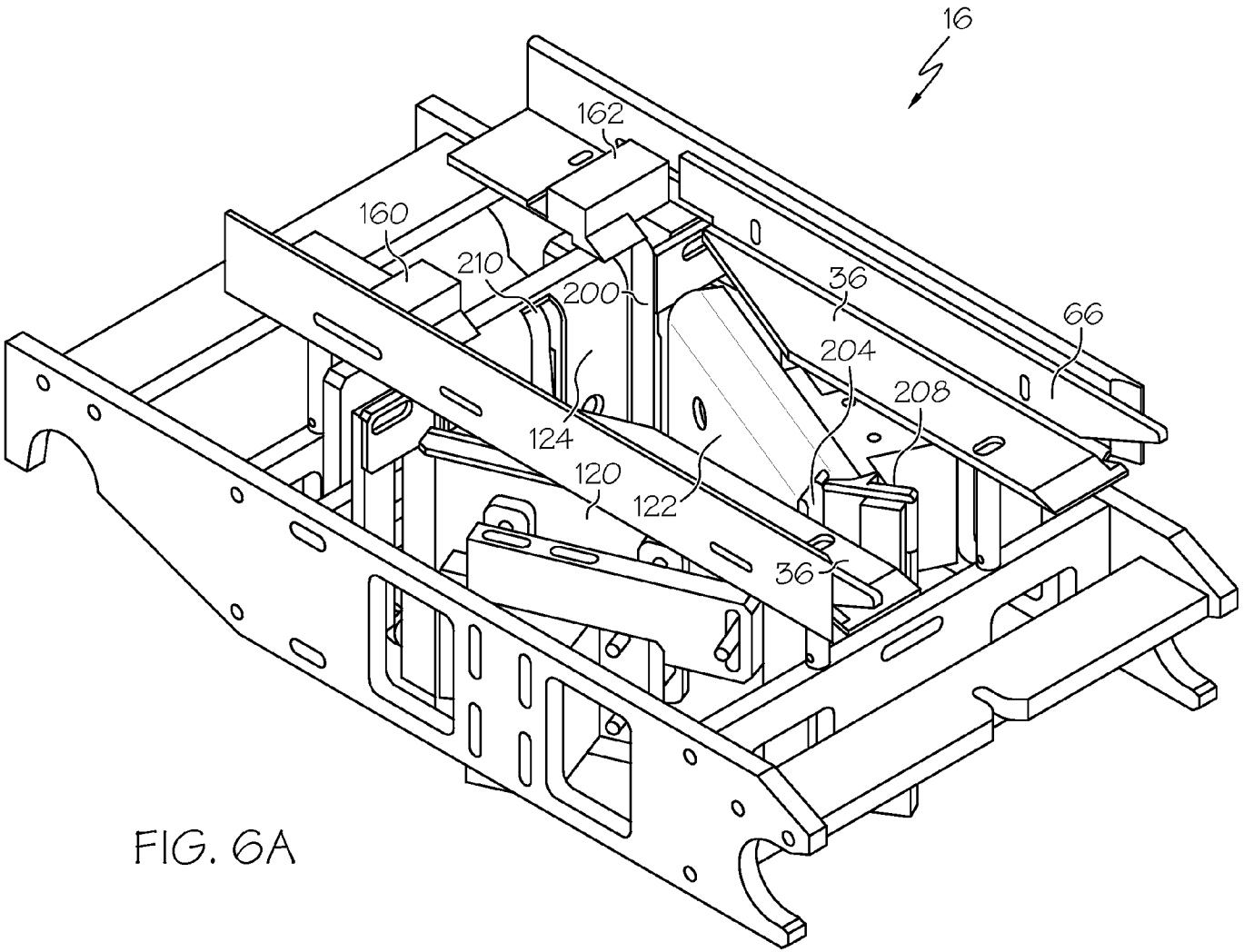
Figure 6B:
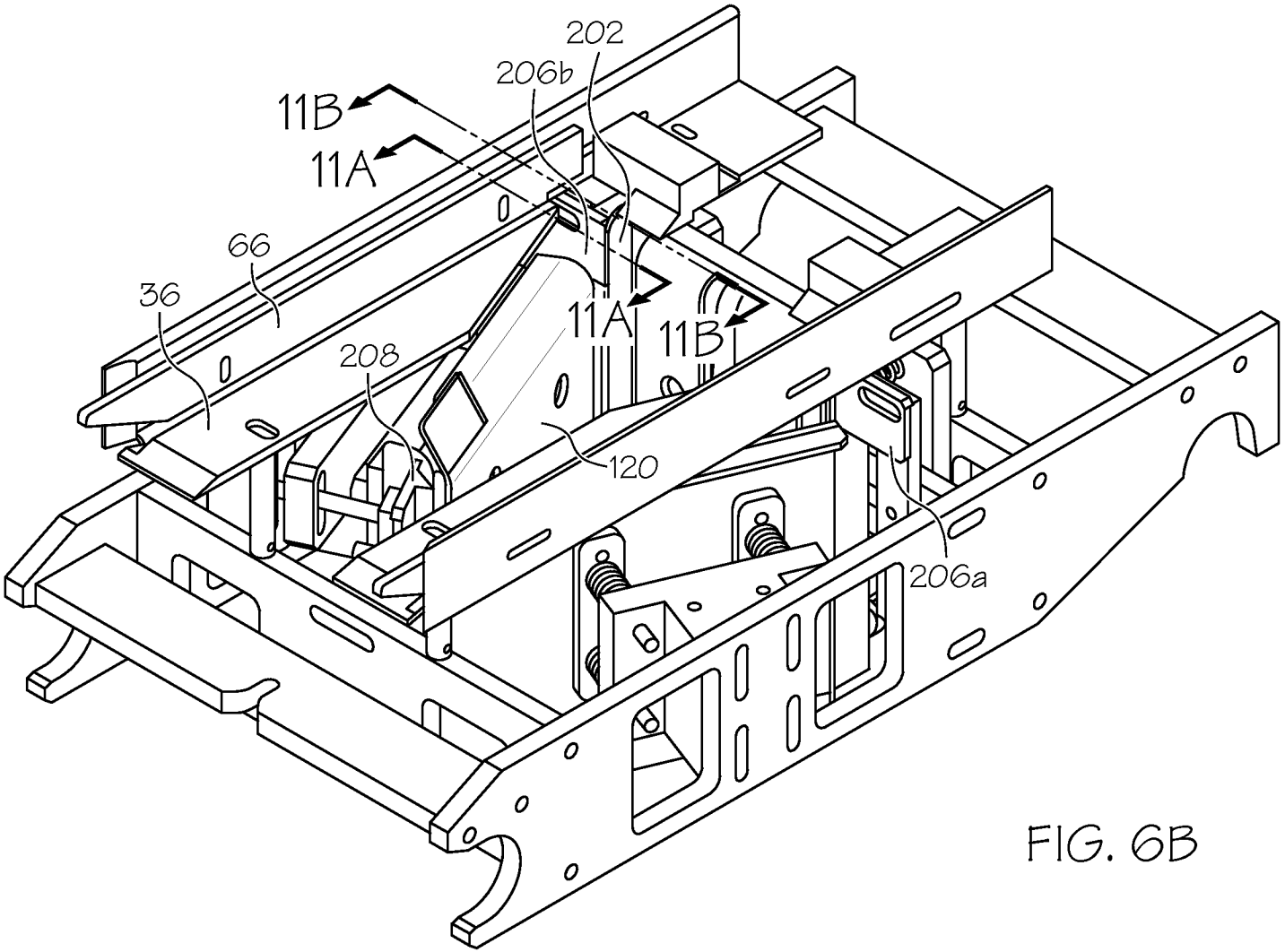
Figure 6C:
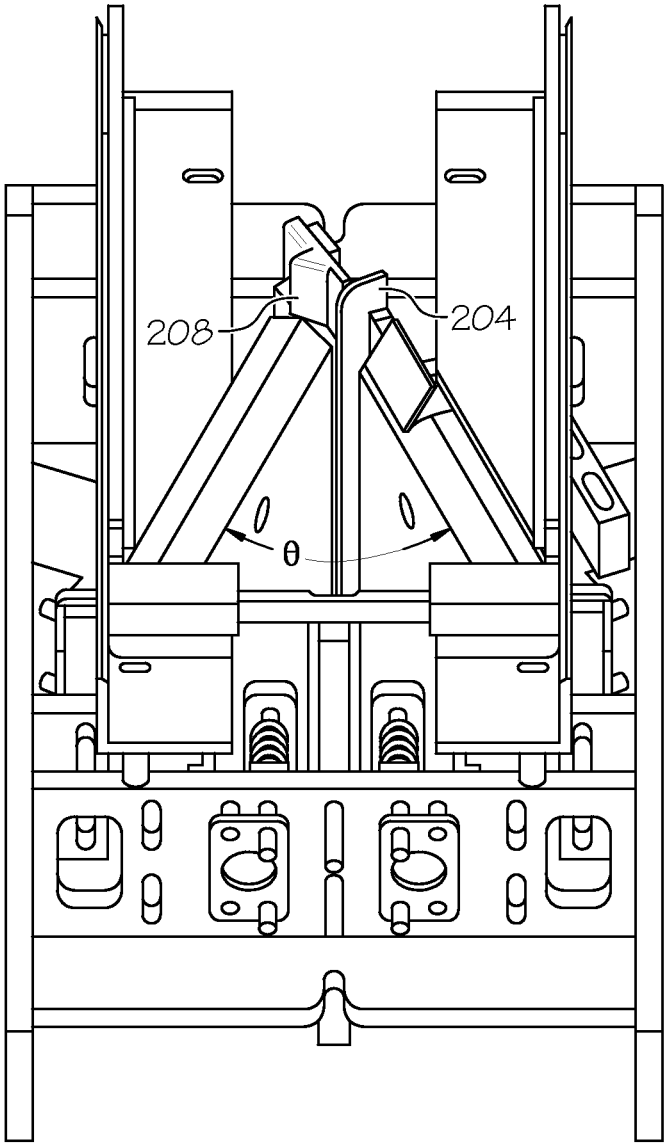

FIGS. 6A-6C show embodiments of the forming cavity 16.

Figure 7:
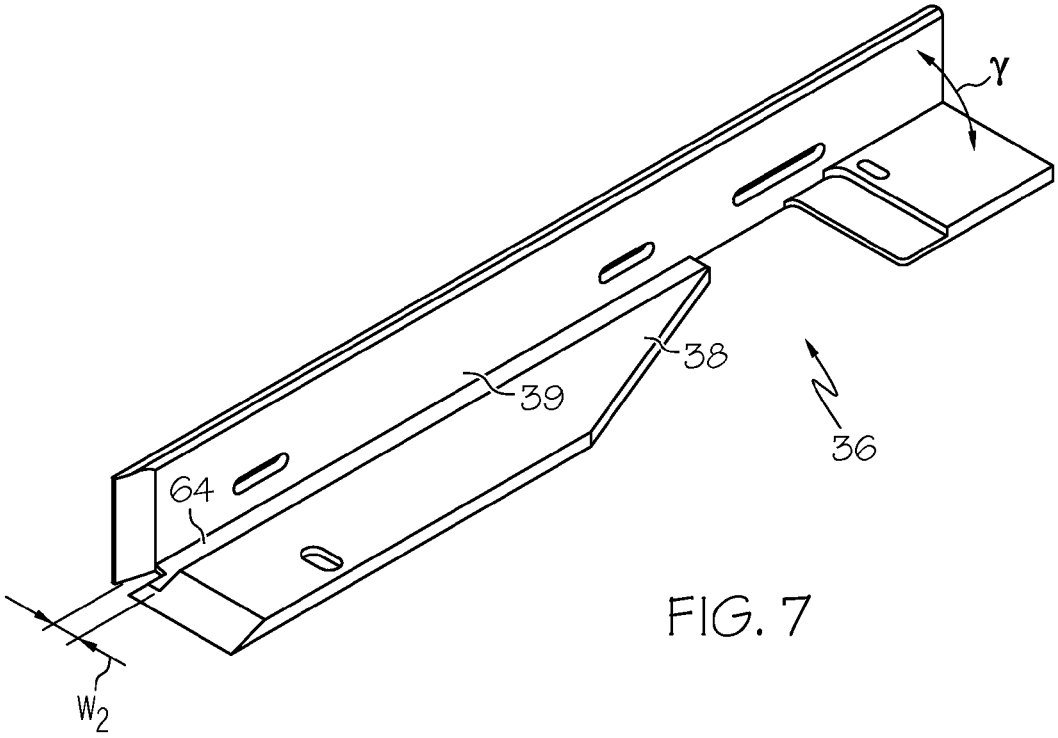
Figure 8:
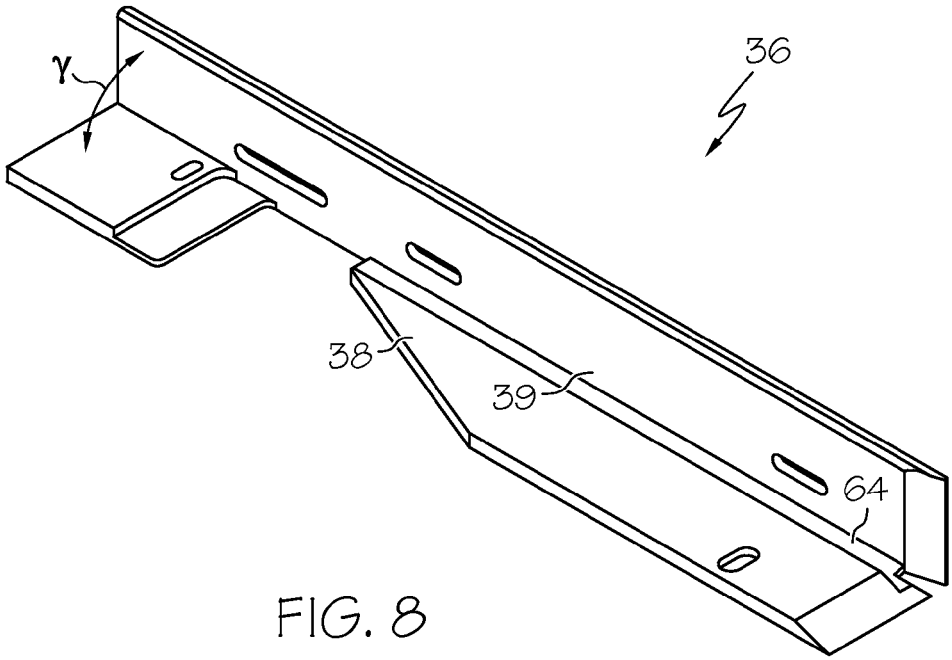

FIGS. 7 and 8 show embodiments of the support guides 36.

Figure 9:
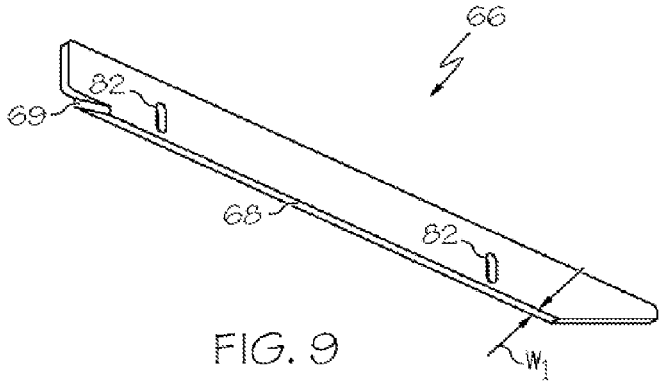
Figure 10:
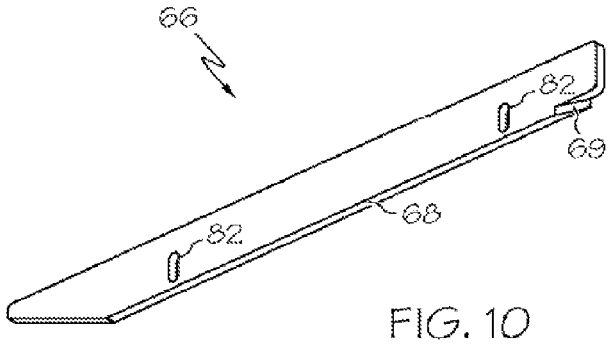

FIGS. 9 and 10 show embodiments of rail 66.

Figure 11A:
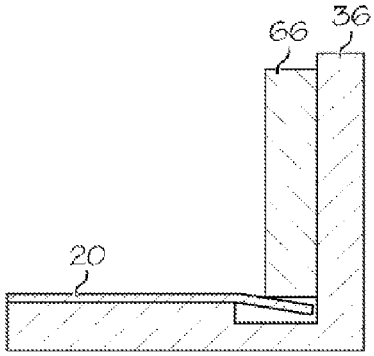
Figure 11B:
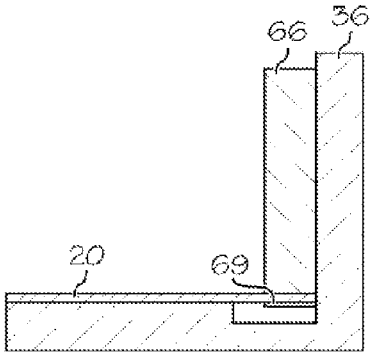

FIGS. 11A and 11B show the support guides 36 of FIGS. 7 and 8 and rails 66 of FIGS. 9 and 10 in cross-section.

Figure 1:
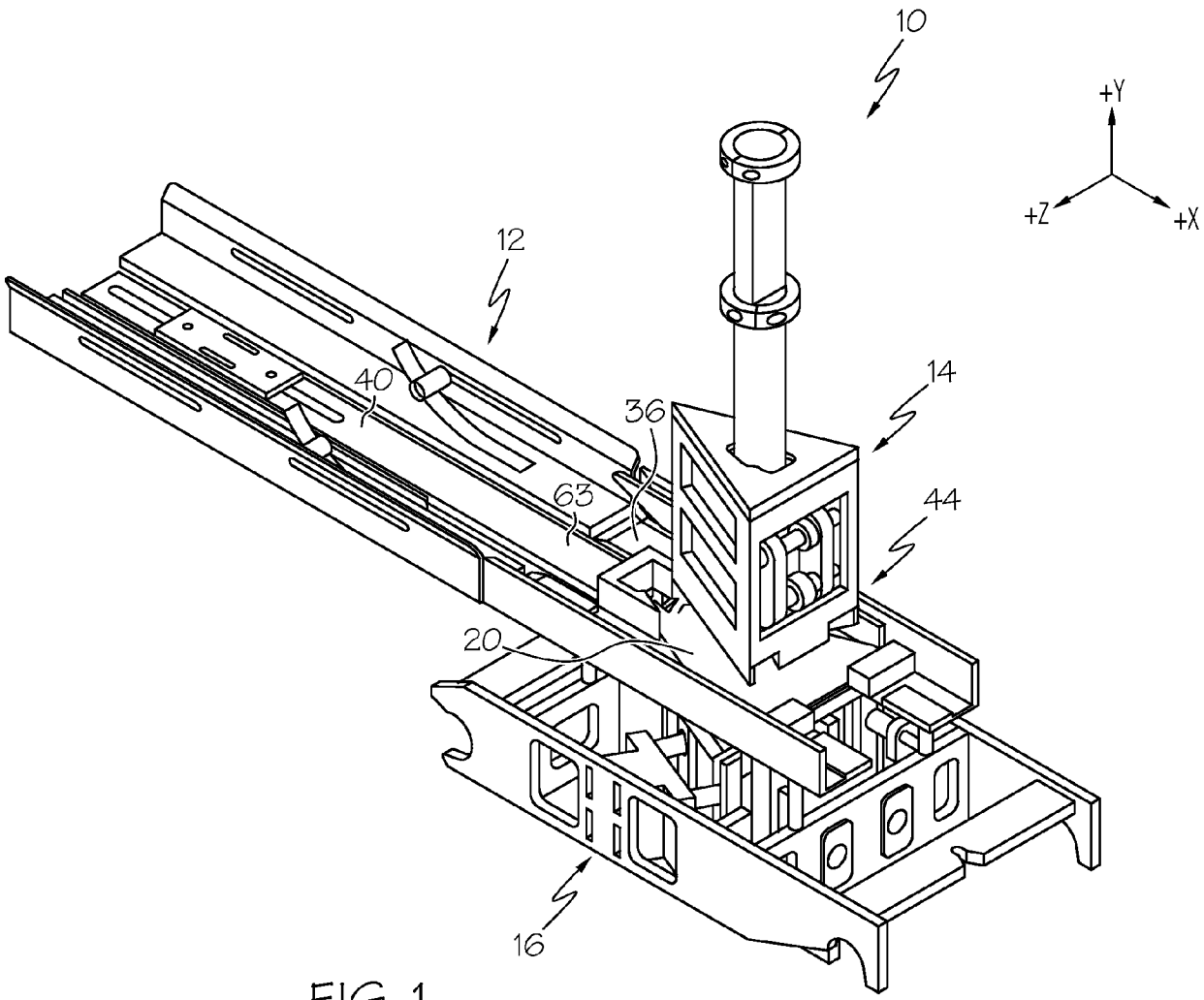
Figure 12A:
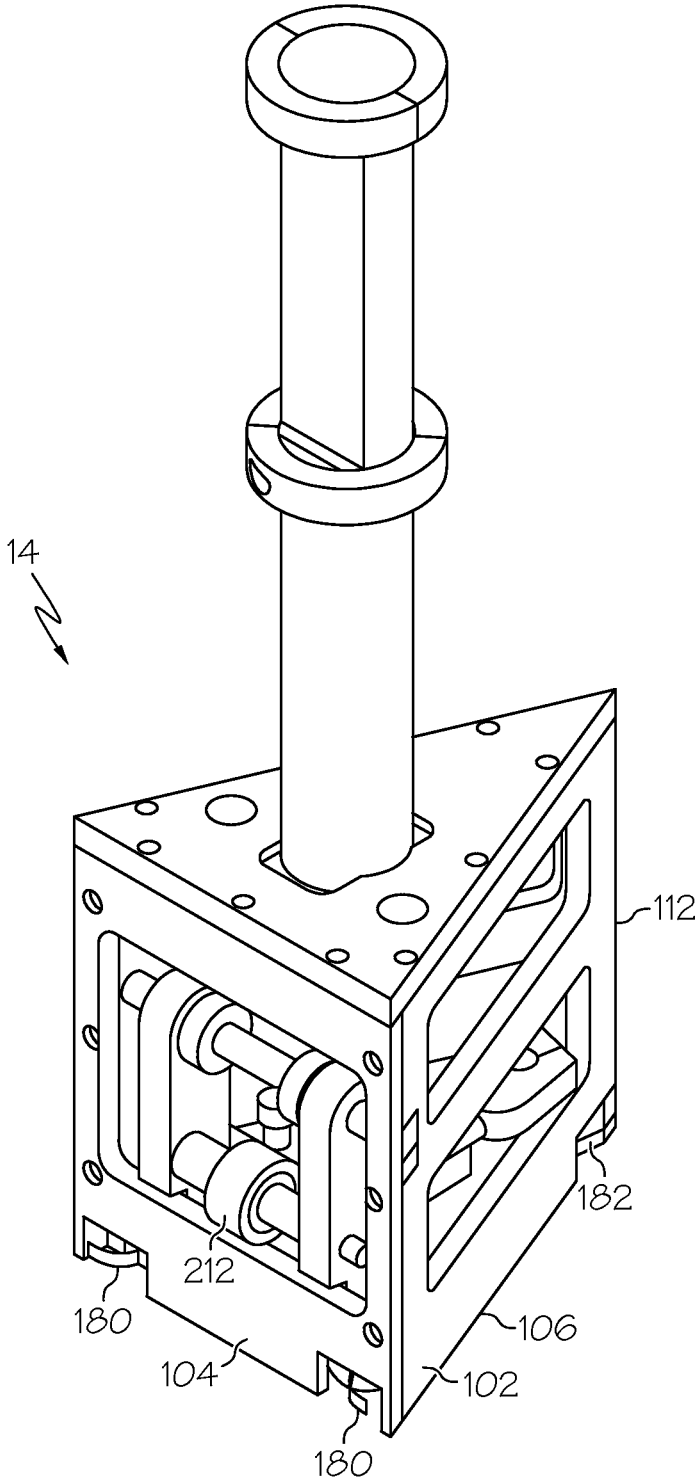
Figure 12B:
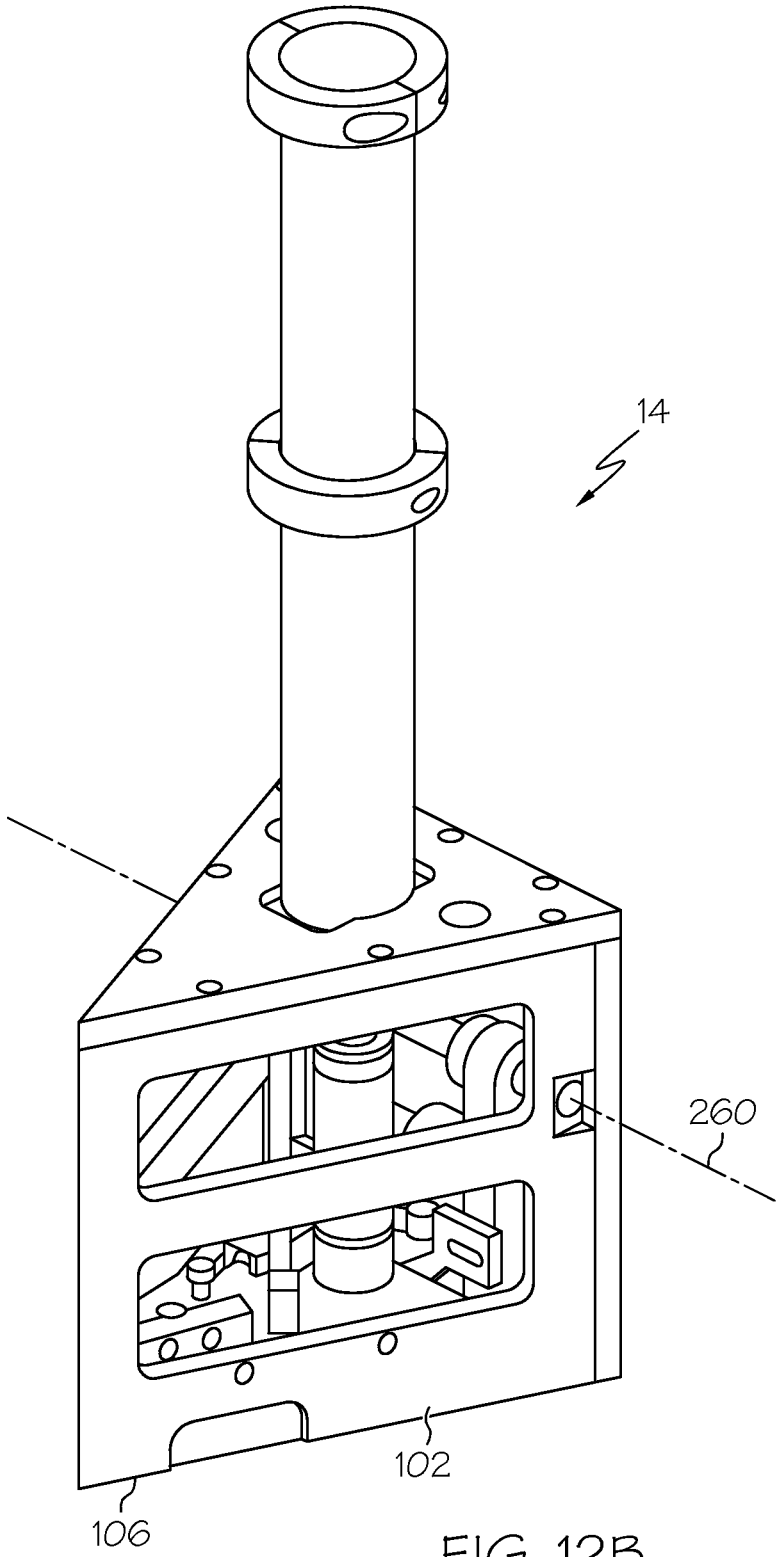

FIGS. 12A and 12B show the forming head of FIG. 1 in greater detail.

Figure 13:
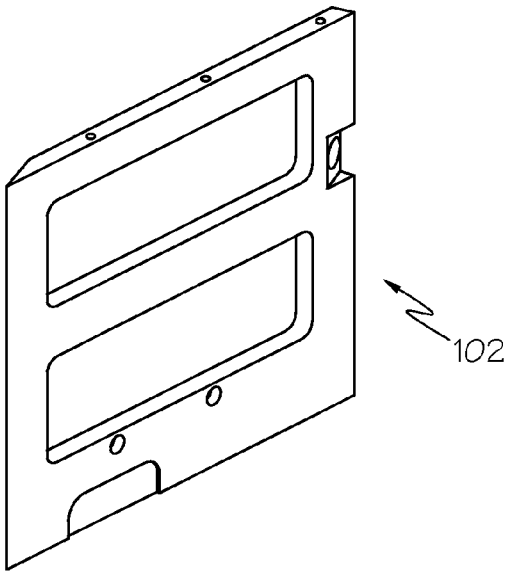
Figure 14:
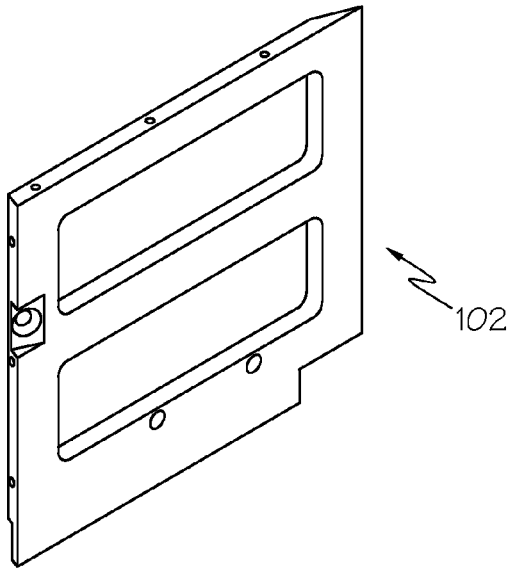

FIGS. 13 and 14 show embodiments of the forming head side plates 102 of FIGS. 12A and 12B.

Figure 15:
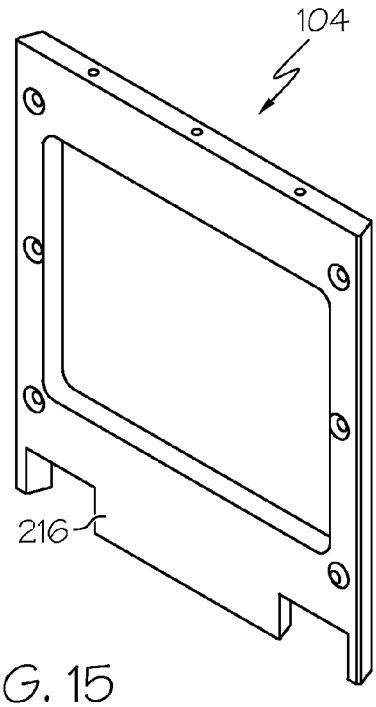

FIG. 15 shows an embodiment of the forming head back plate 104 of FIGS. 12A and 12B.

Figure 16:
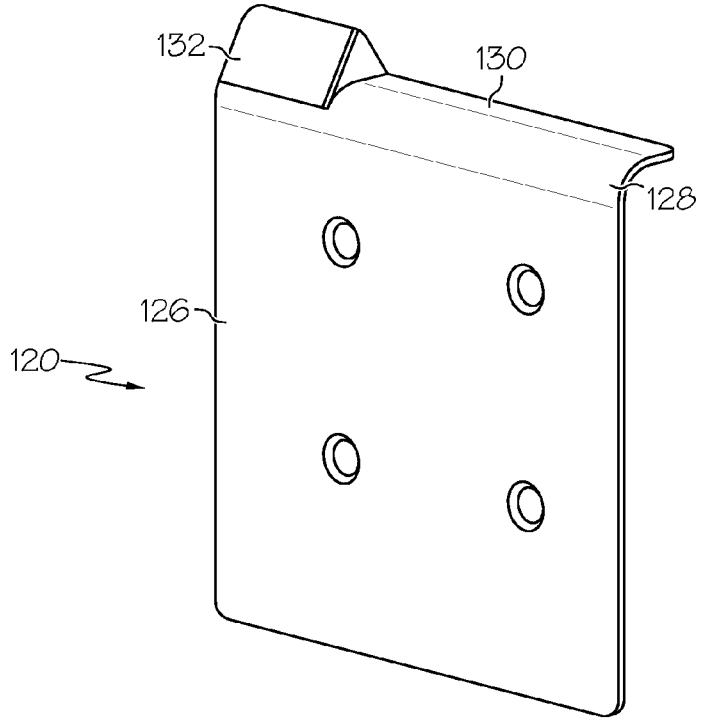

FIG. 16 shows an embodiment of the first cavity side plate 120.

Figure 17:
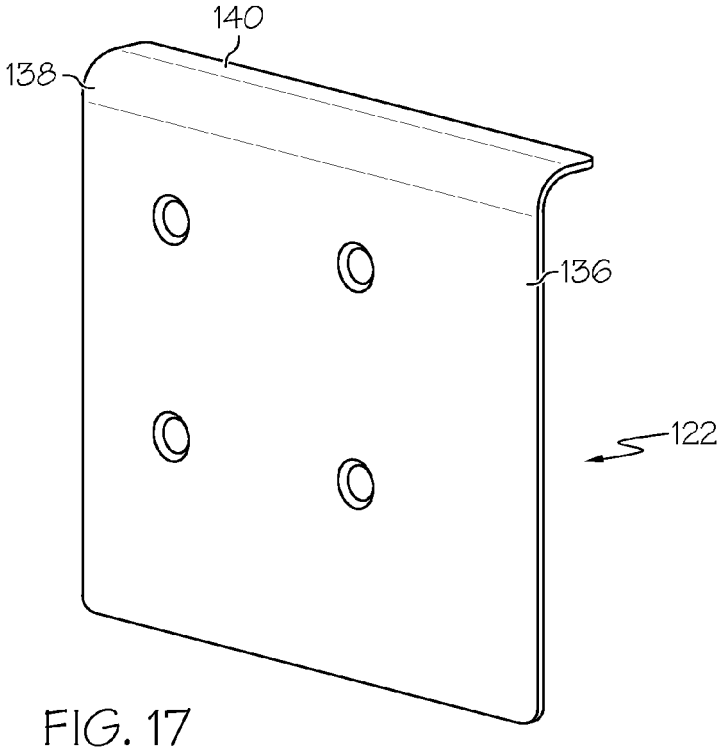

FIG. 17 shows an embodiment of the second cavity side plate 122.

Figure 18:
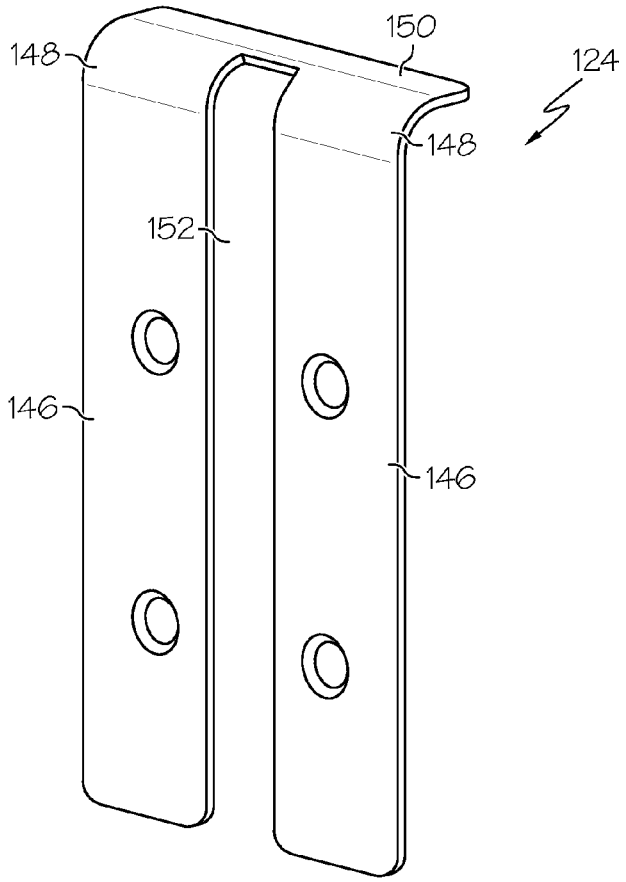

FIG. 18 shows an embodiment of the cavity back plate 124.

FIGS. 19A, 19B, 20A, and 20B show detailed views of embodiments of the rear fingers 180.

Figure 21A:
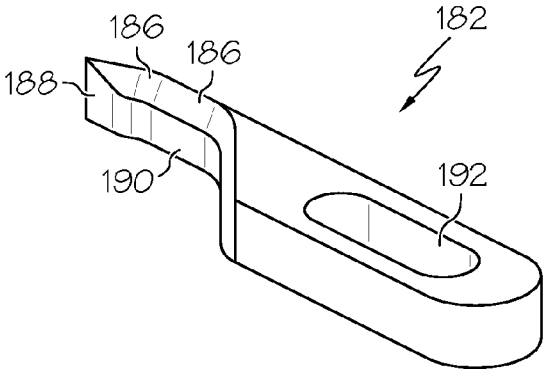
Figure 21B:
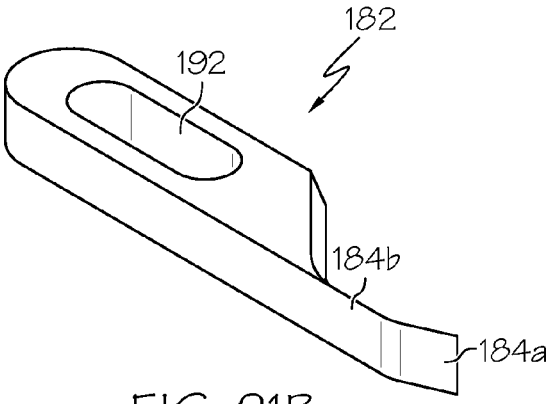

FIGS. 21A and 21B show an embodiment of the front finger 182.

Figure 22:
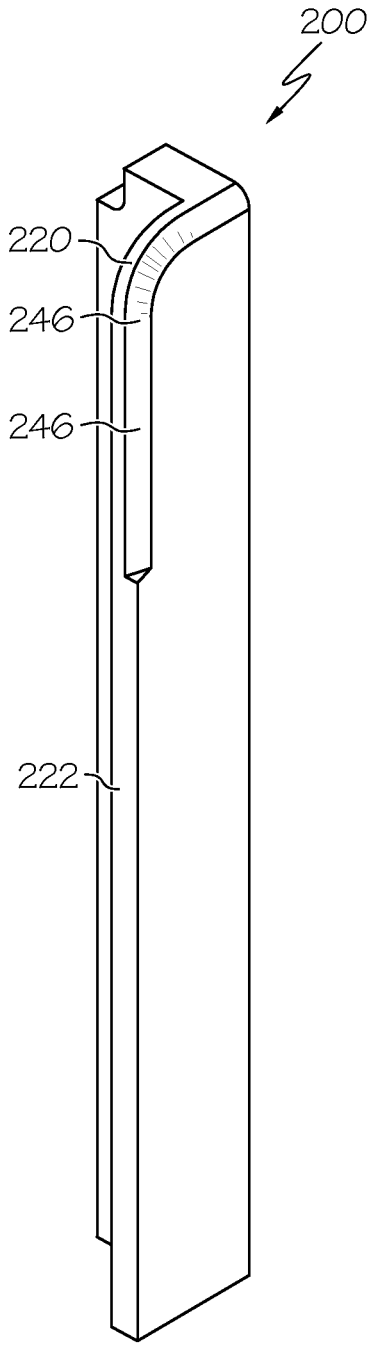
Figure 23:
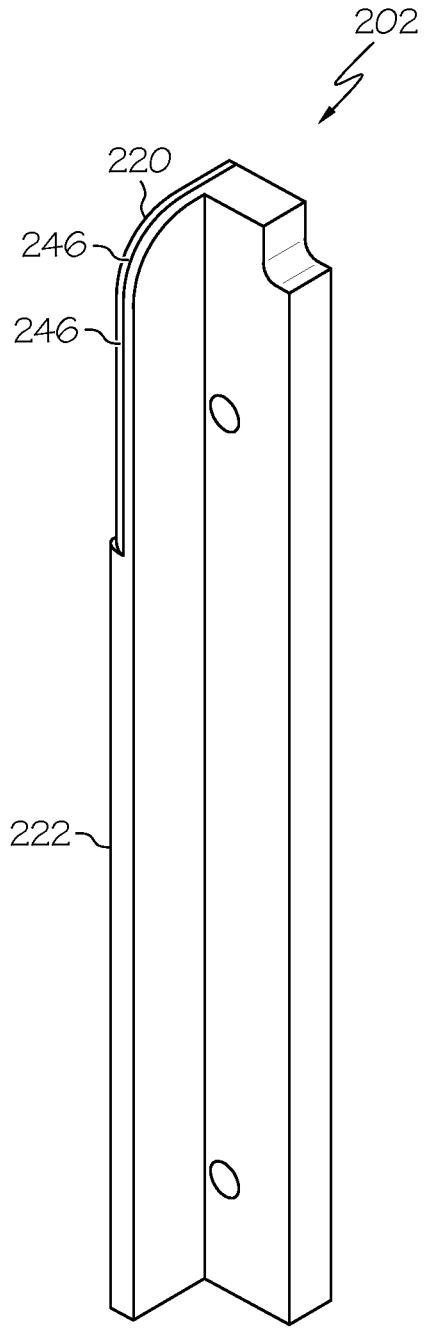
Figure 24:
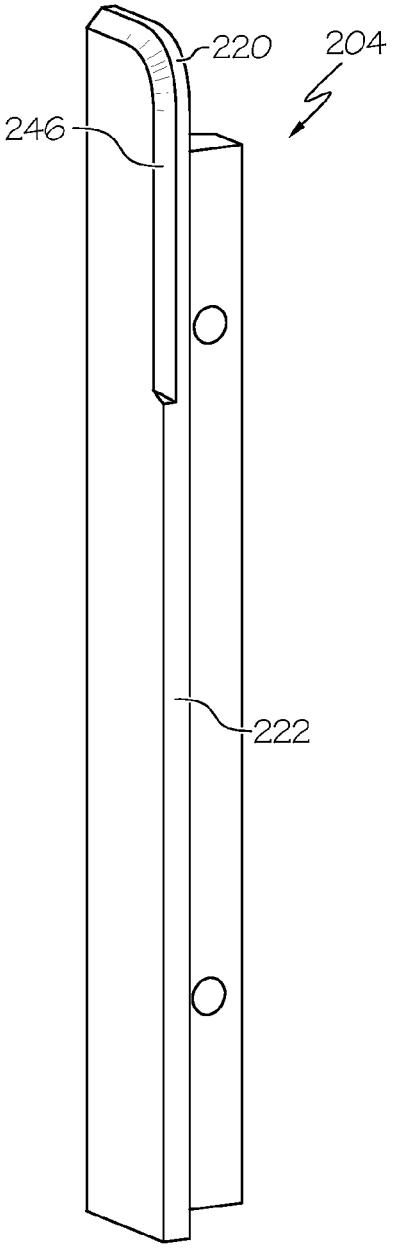

FIGS. 22-24 show detailed view of embodiments of the first, second, and third latching guides 200, 202, and 204 respectively.

Figure 25:
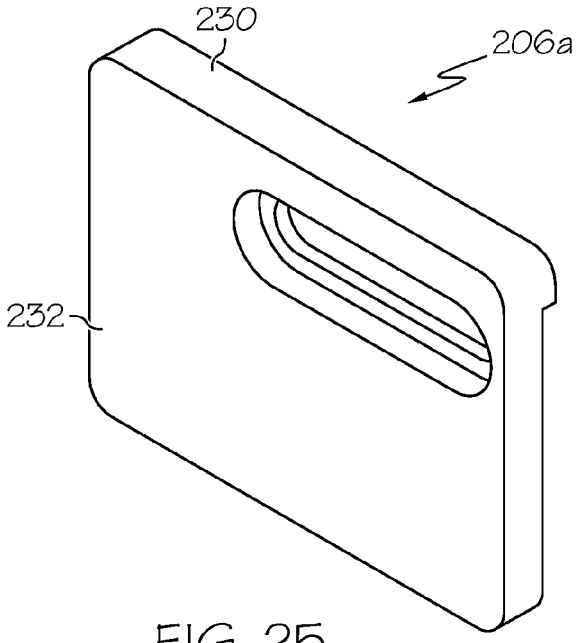
Figure 26:
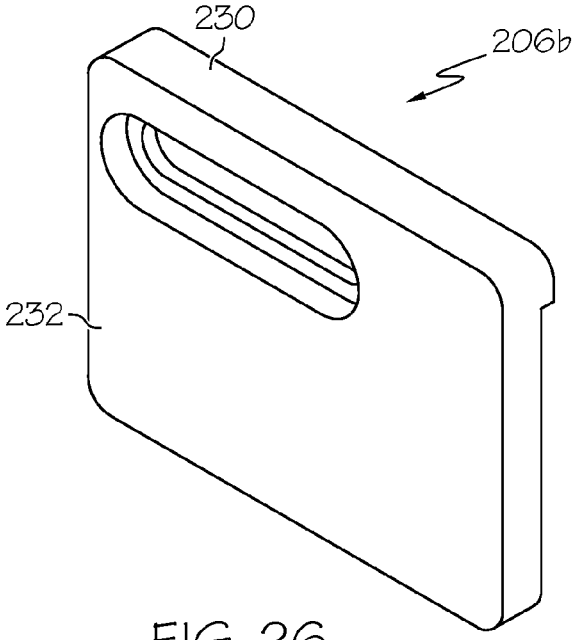

FIGS. 25 and 26 show detailed views of particular embodiments of the minor tab guides, 206*a* and 206*b*, respectively.

Figure 27A:
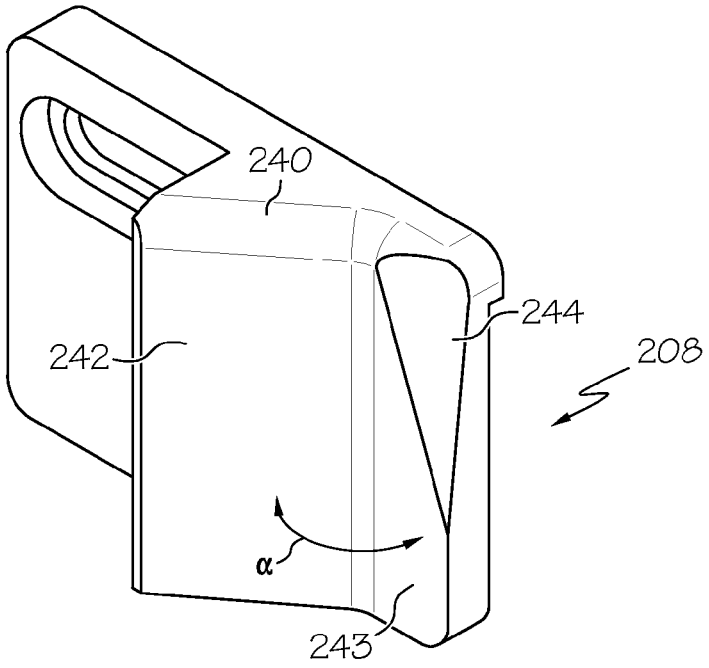
Figure 27B:
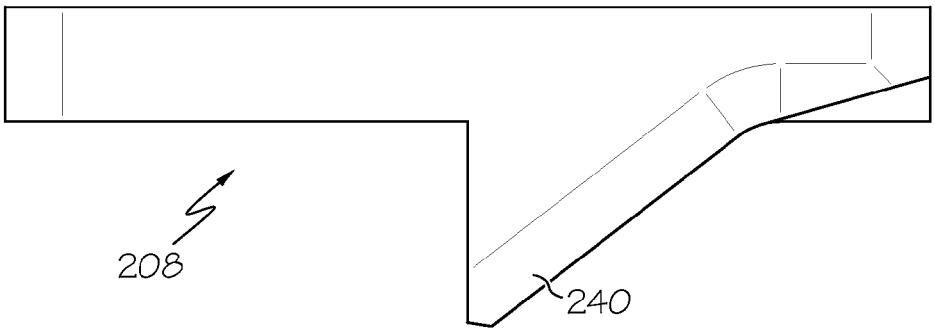

FIGS. 27A and 27B show detailed views of an embodiment of the minor folding member 208.

Figure 28:
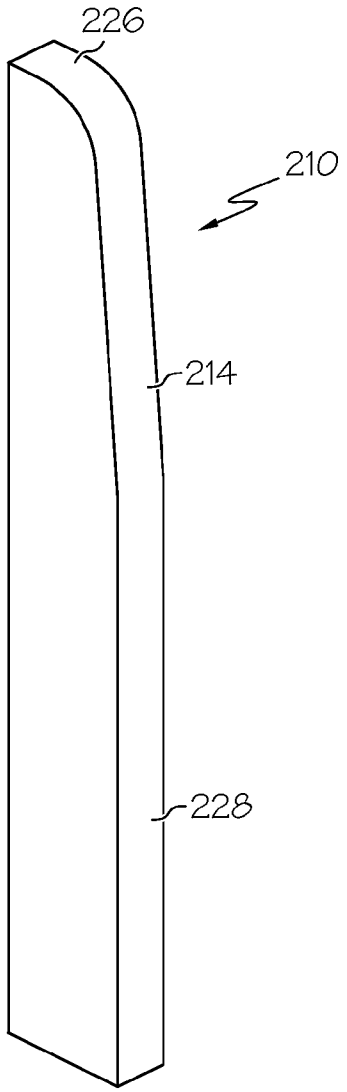

FIG. 28 shows a detailed view of an embodiment of the roller guide 210.

Figure 29:
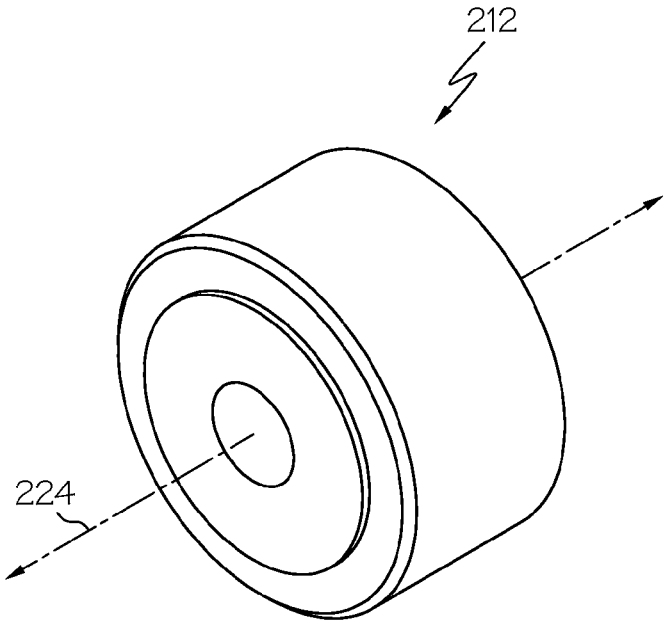

FIG. 29 shows a detailed view of the roller 212.

Figure 30:
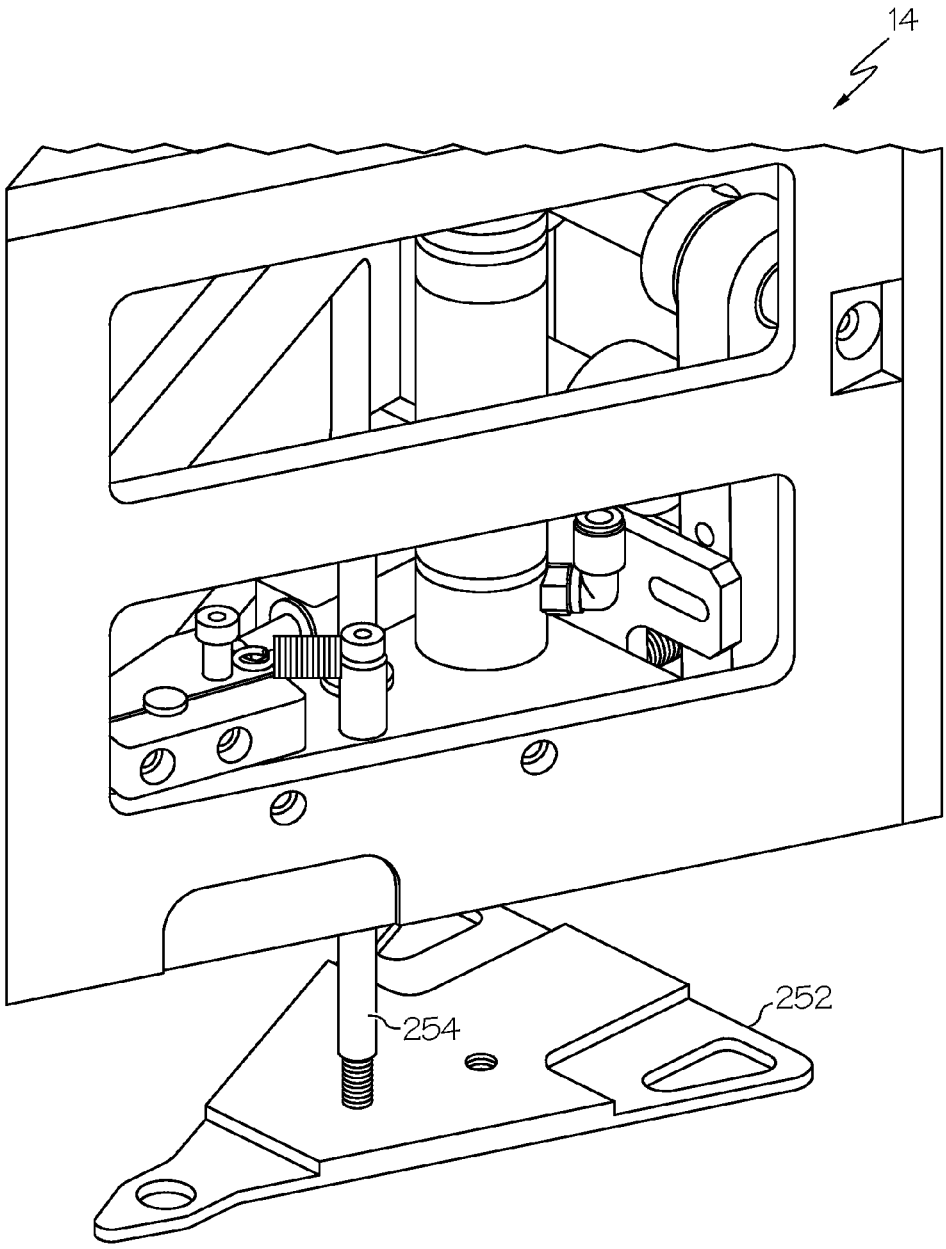

FIG. 30 shows a detailed view of an embodiment of the forming head 14 of FIG. 1.

Figure 31:
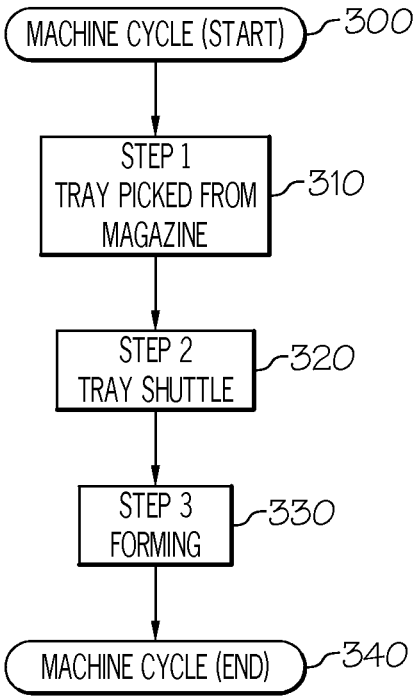

FIG. 31 is a flow chart depicting the loading and forming process for forming a carton.

Figure 32:
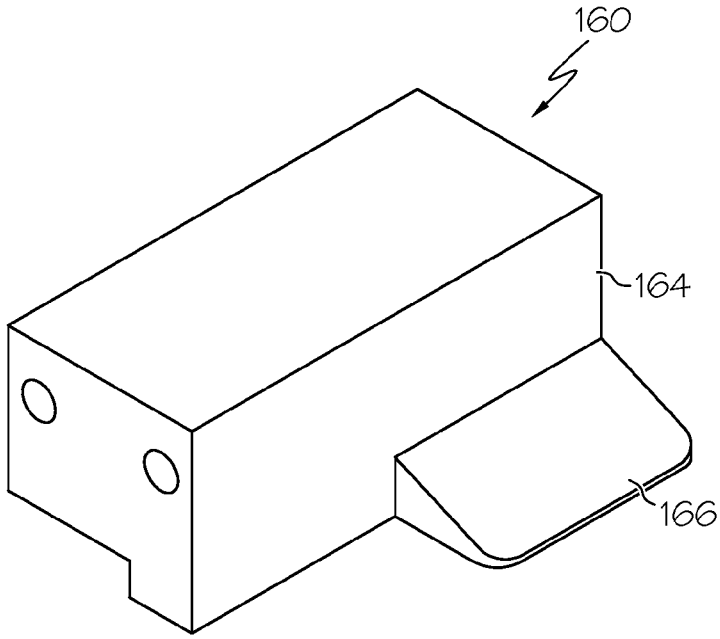
Figure 33:
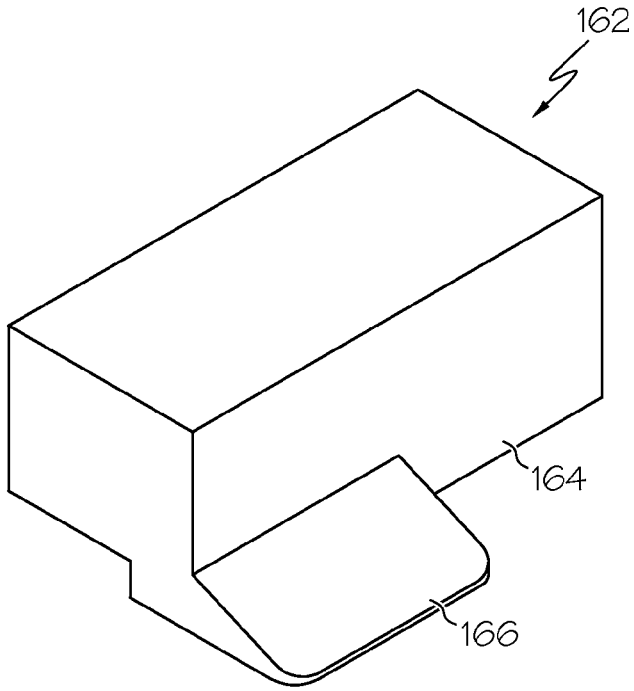

FIGS. 32 and 33 show detailed views of the rear stops 160 and 162, respectively.

Figure 34:
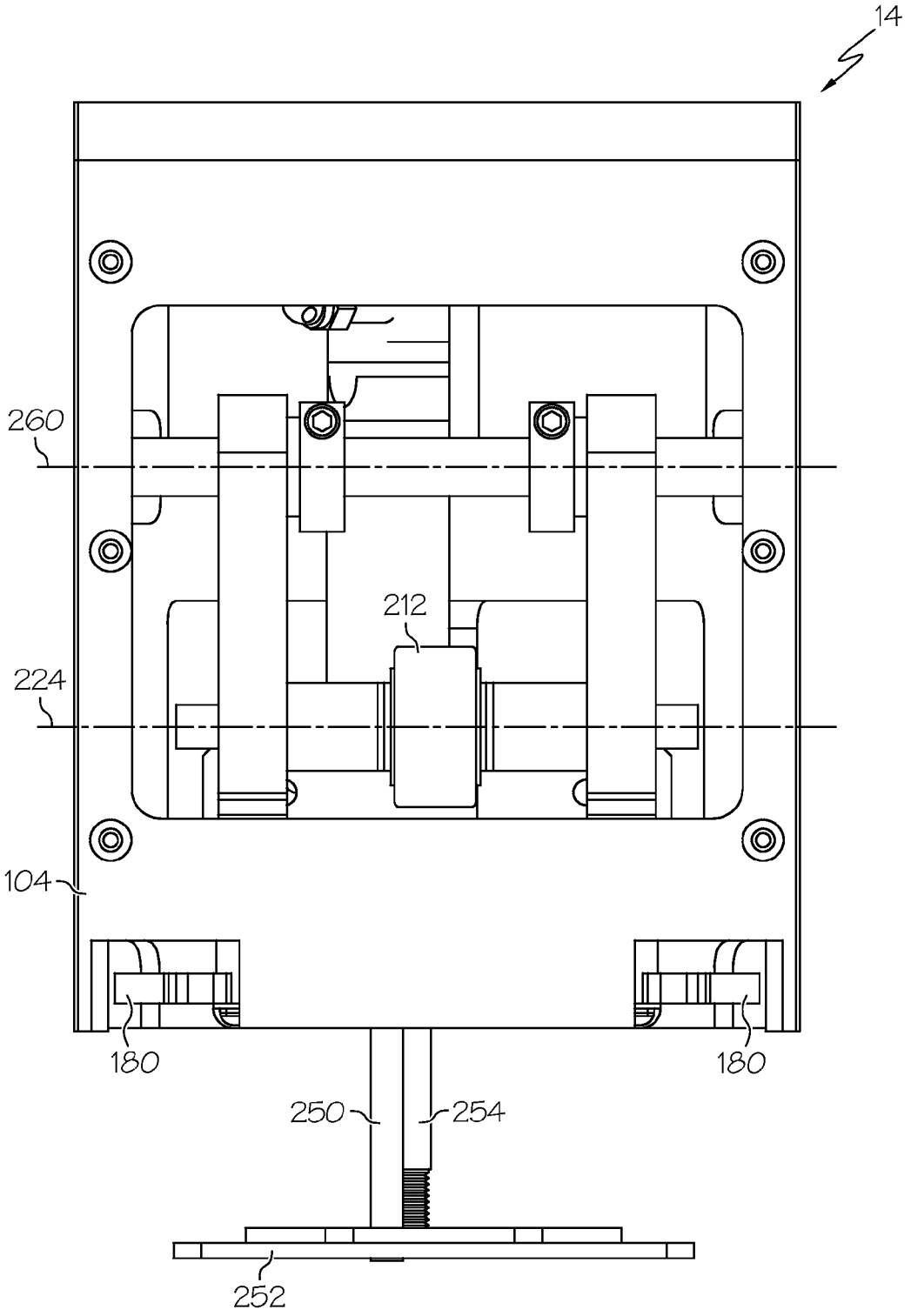

FIG. 34 shows a back view of the forming head 14.

Figure 35:
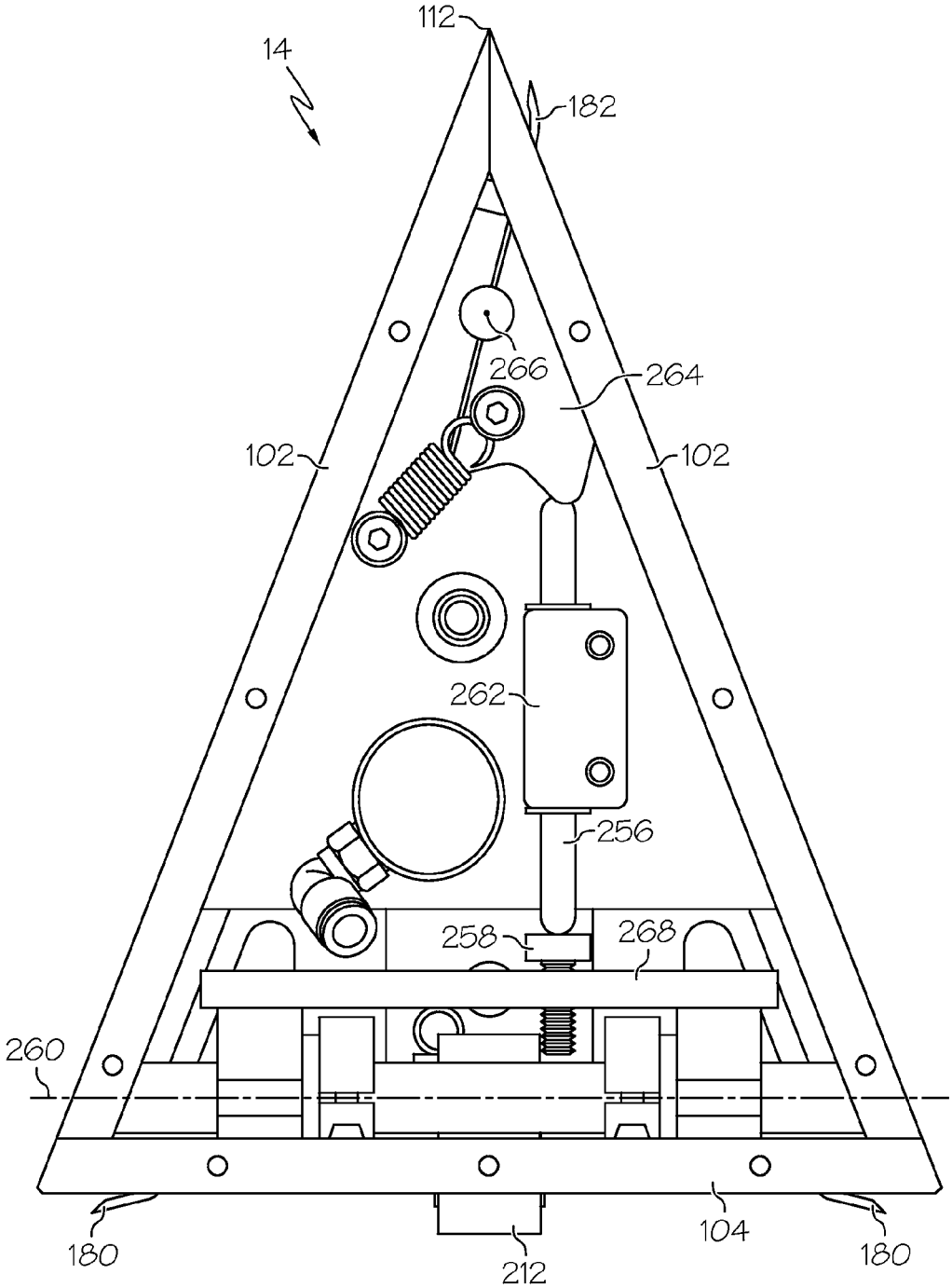

FIG. 35 shows a top view of the forming head 14.

Figure 36:
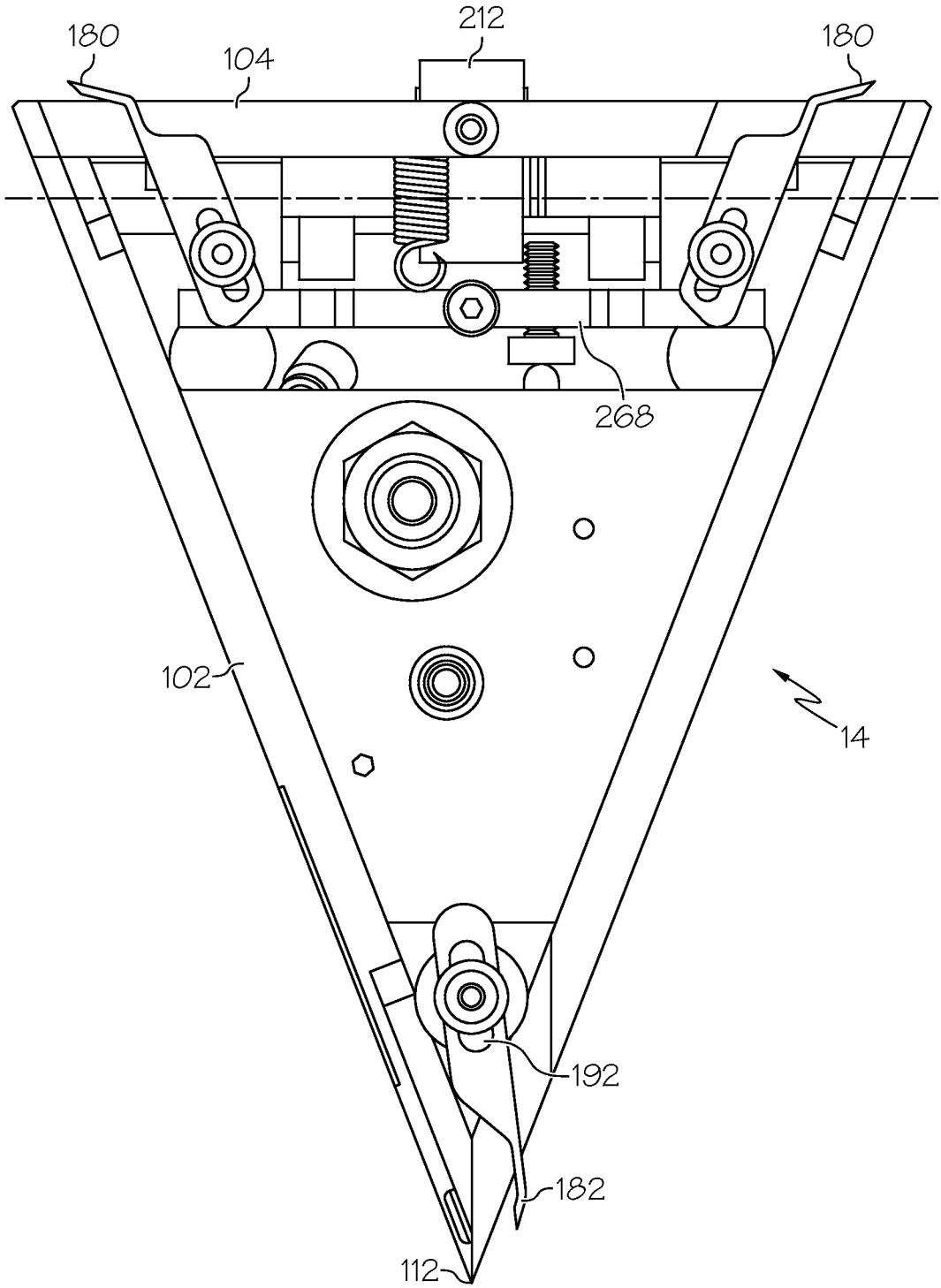

FIG. 36 shows bottom view of the forming head 14.

Figure 37:
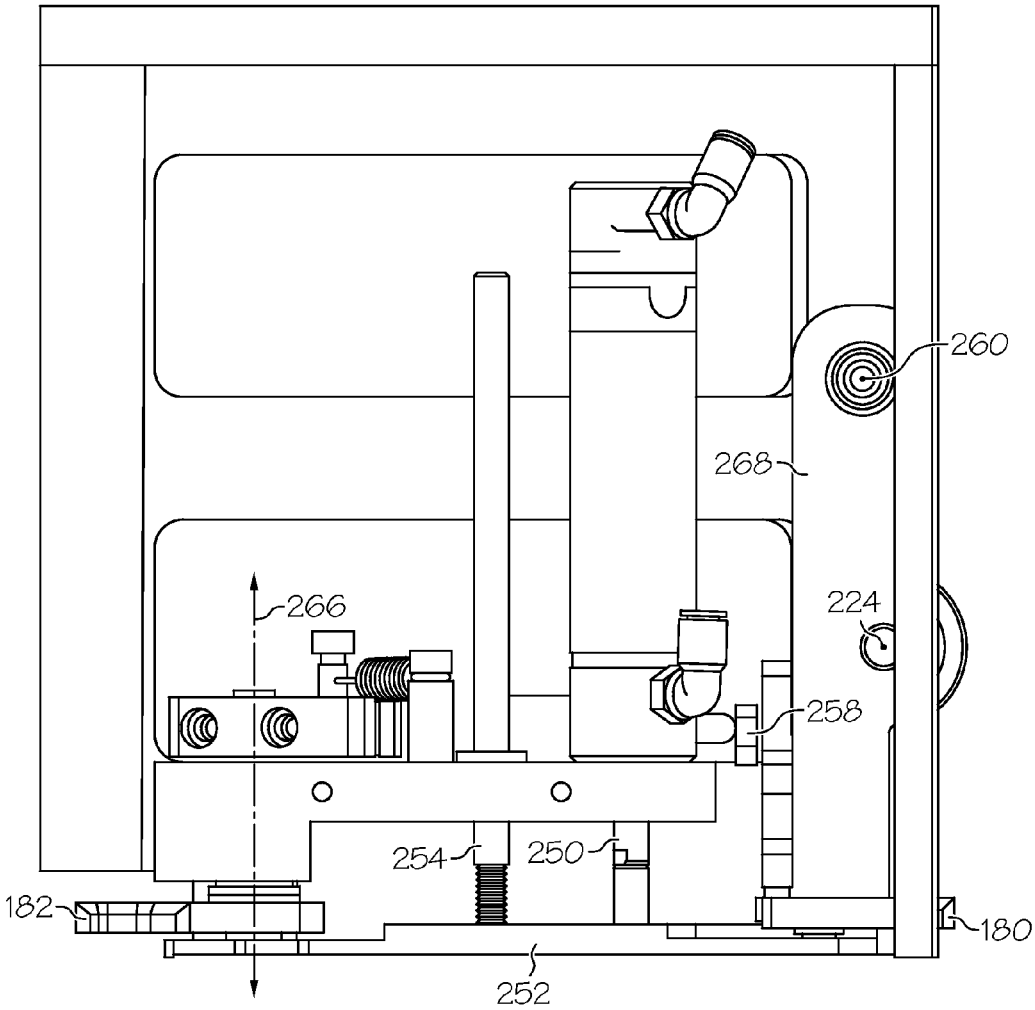

FIG. 37 shows a side cutaway view of the forming head 14.

Figure 38:
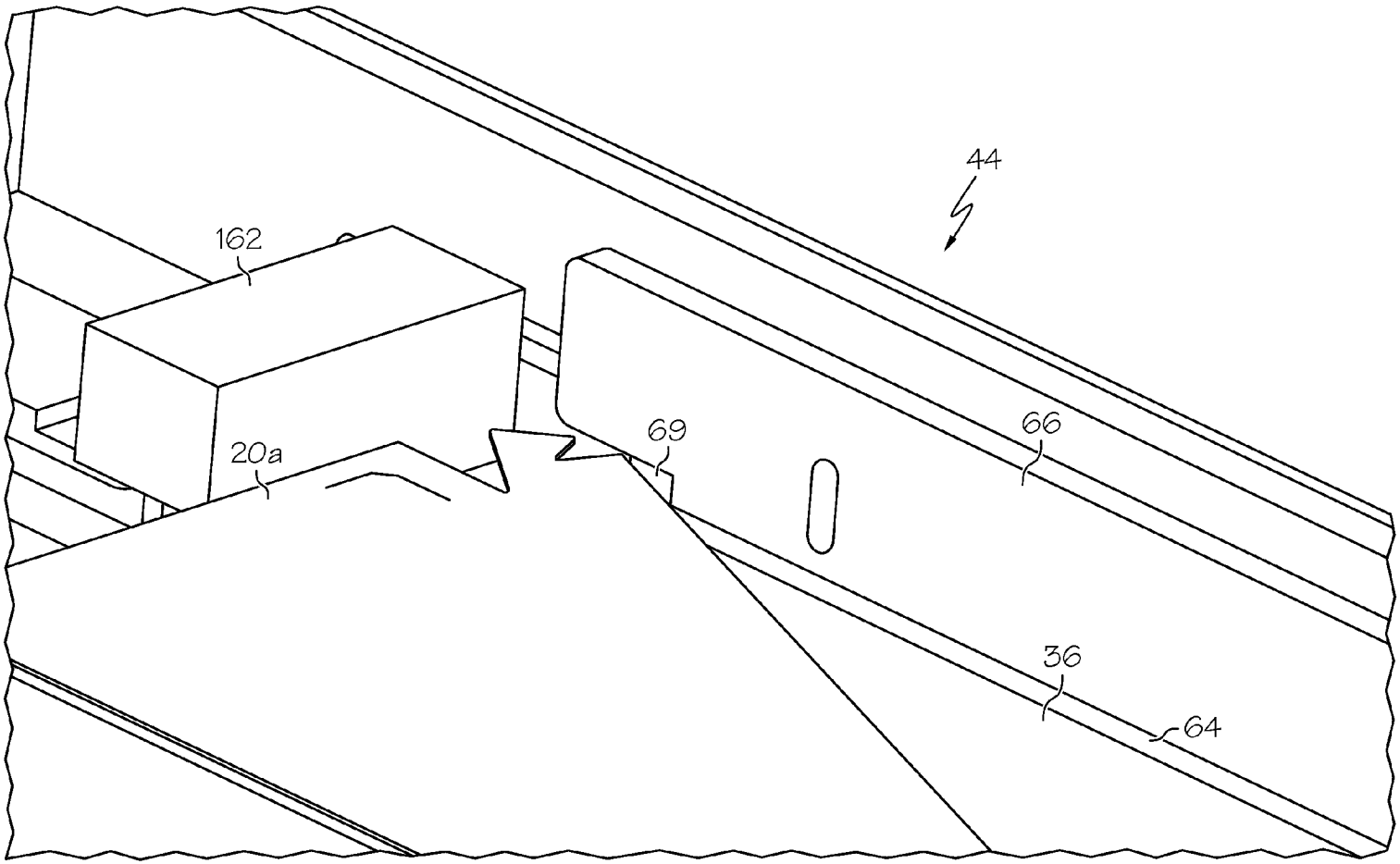

FIG. 38 shows a detailed view of a portion of the carton 20 at the carton forming station 44.

DETAILED DESCRIPTION OF THE INVENTION

While this invention may be embodied in many different forms, there are described in detail herein specific embodiments. This description is an exemplification of the principles of the invention and is not intended to limit it to the particular embodiments illustrated.

For the purposes of this disclosure, like reference numerals in the figures shall refer to like features unless otherwise indicated.

Figure 4A:
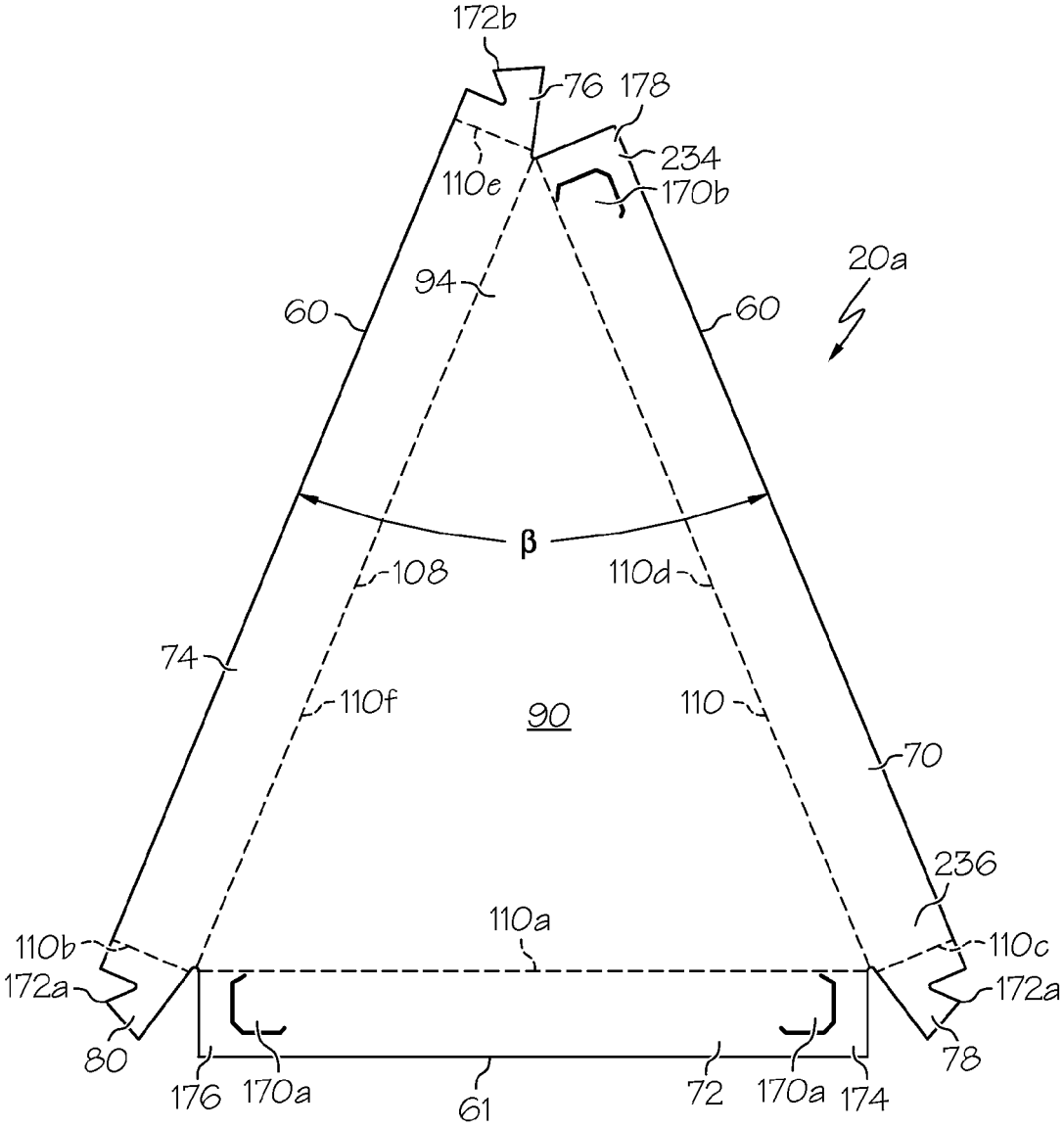
FIG. 4A shows an embodiments of a carton blank 20*a*.
Figure 4B:
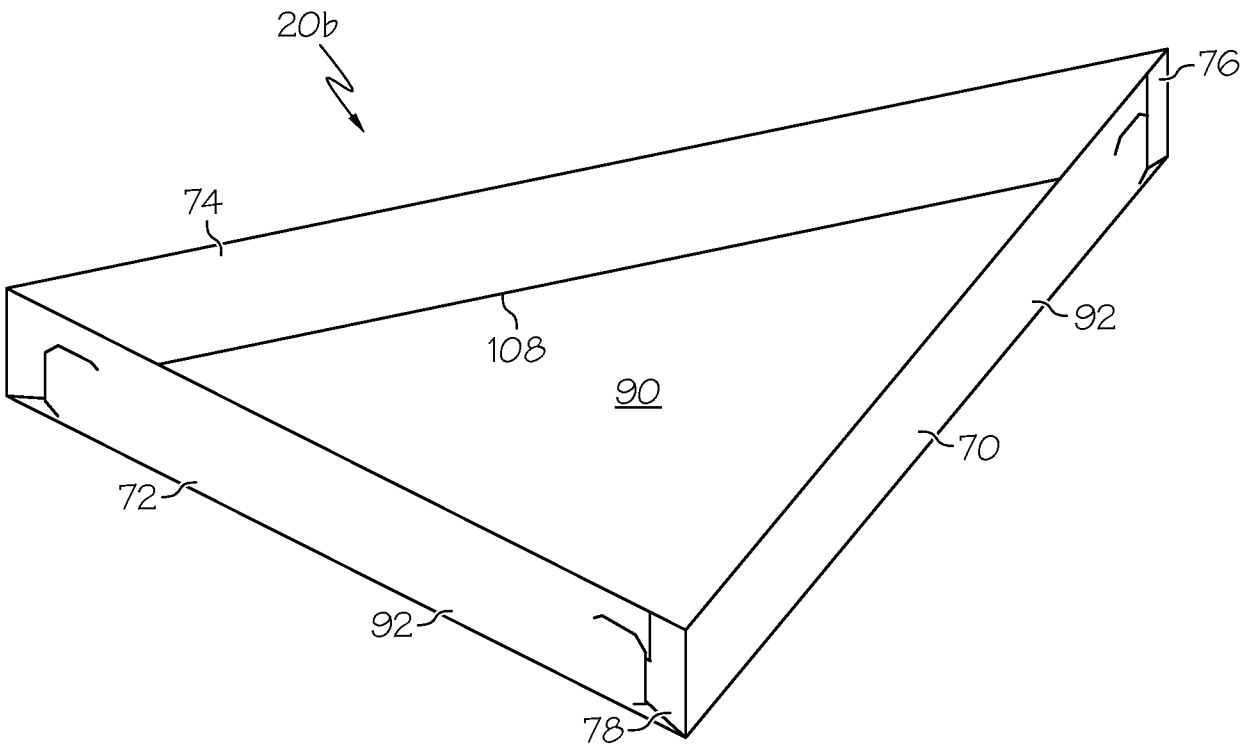
FIG. 4B shows the embodiment of the carton blank 20*a* of FIG. 4A as a formed carton 20*b*.

In at least one embodiment, for example as shown in FIG. 1, a forming assembly 10 comprises a shuttle bed 12, a forming head 14, and a forming cavity 16. The forming assembly 10 turns carton blank 20*a* (shown in FIG. 4A) into formed carton 20*b* (FIG. 4B). As used herein, "carton 20" refers the carton in any of the various stages of formation, whereas "carton blank 20*a*" refers to the carton 20 prior to formation; the term "formed carton 20*b*" refers to the carton 20 after completion of the forming process. The carton 20 may also be referred to herein a as a "tray" or "container."

Figure 2A:
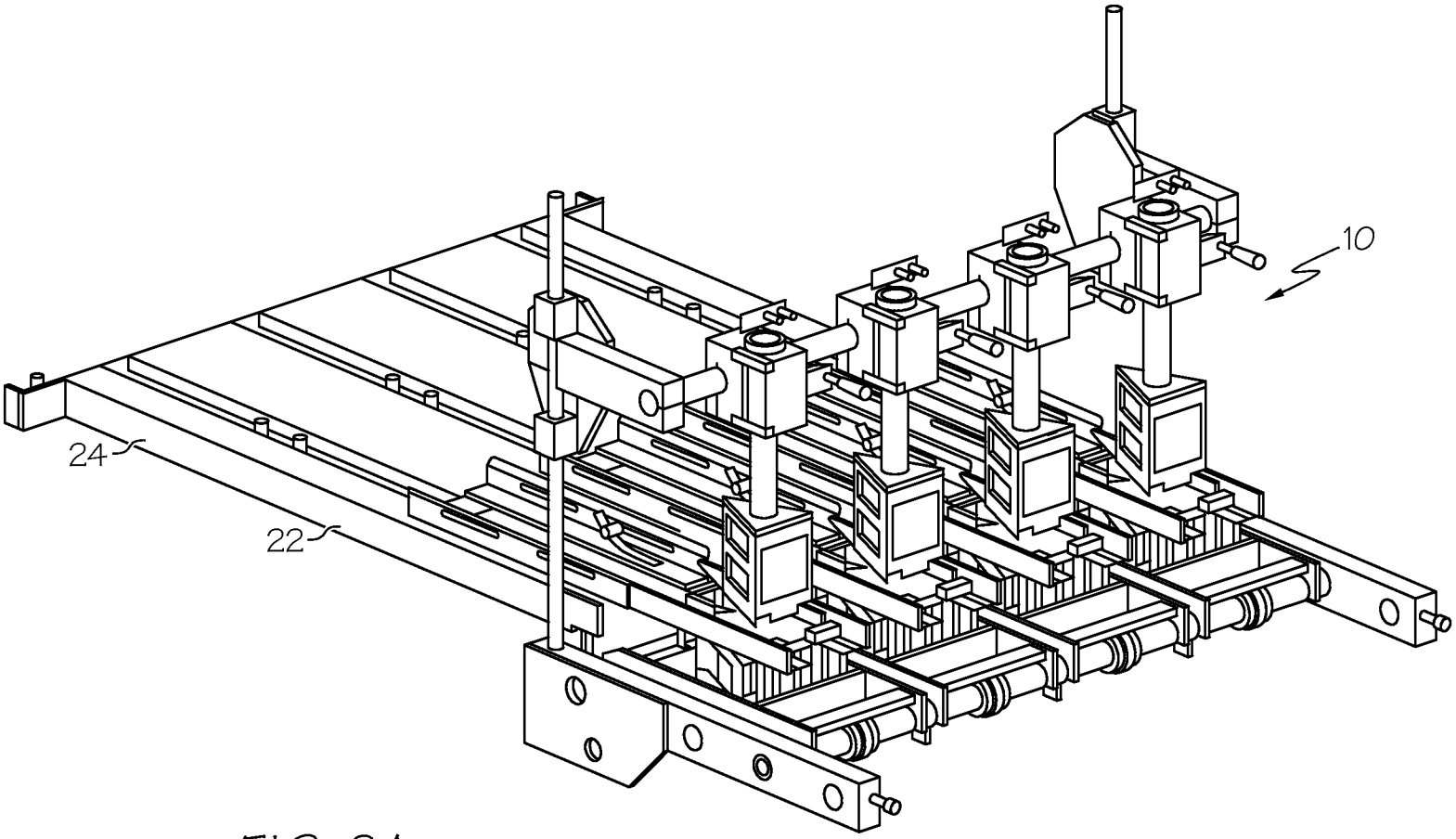
Figure 2B:
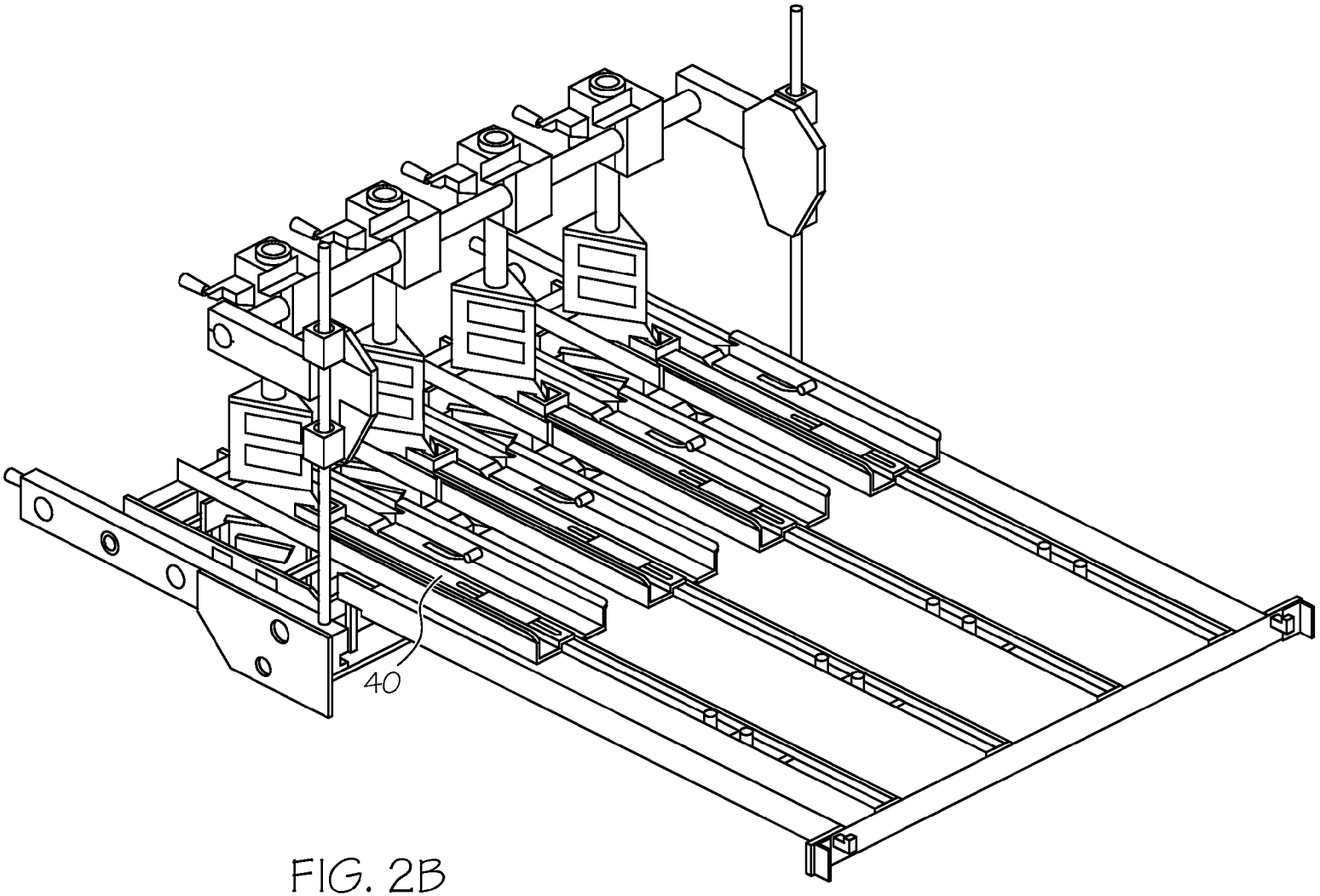

Turning to FIGS. 2A and 2B, in some embodiments, a number of forming assemblies 10 can be connected to one another for parallel production and simultaneous formation of cartons 20. In some embodiments, 2, 3, 4, 5, 6, 7, 8, 9, 10, or more assemblies can be connected together for more rapid production.

Figure 2C:
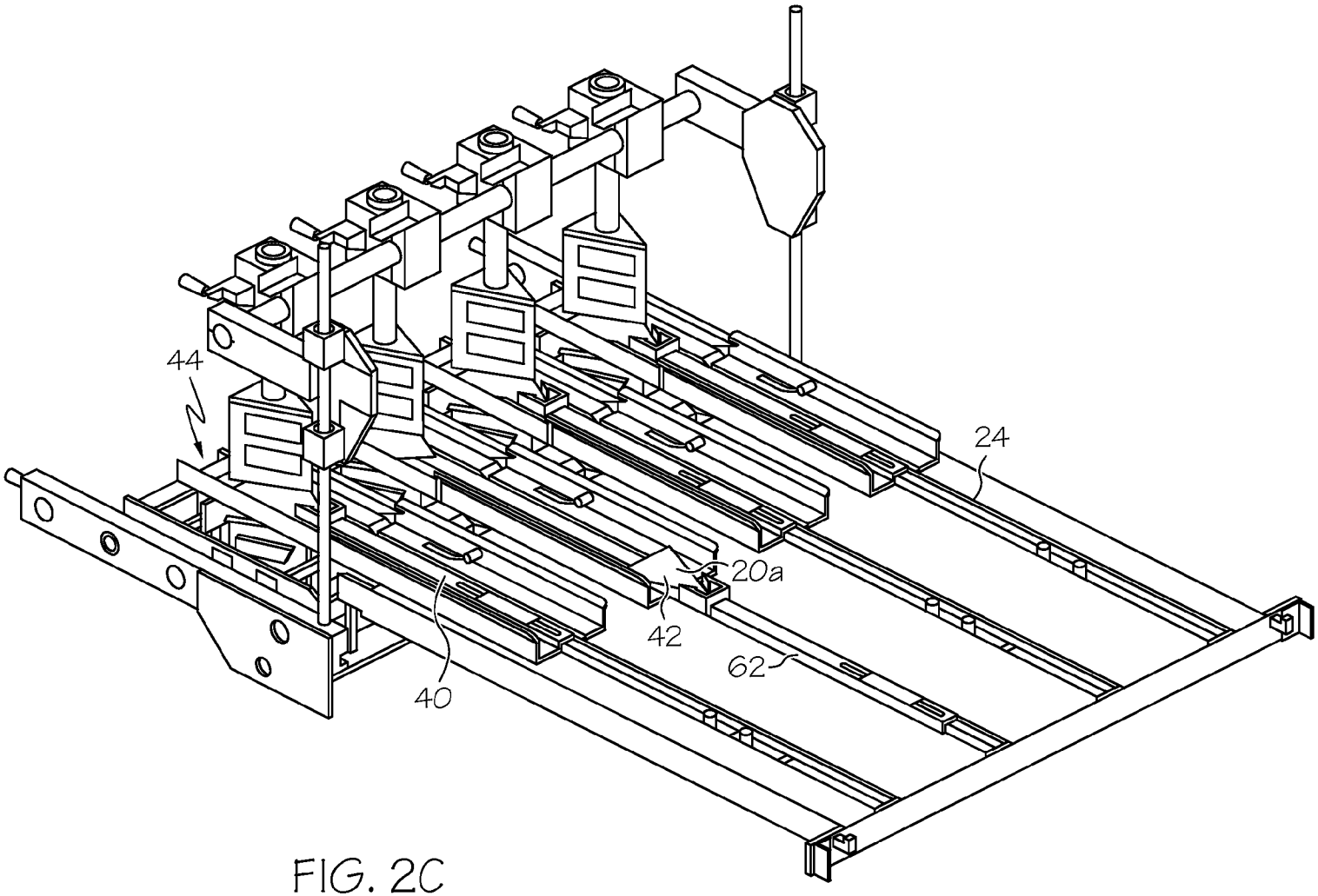
Figure 3:
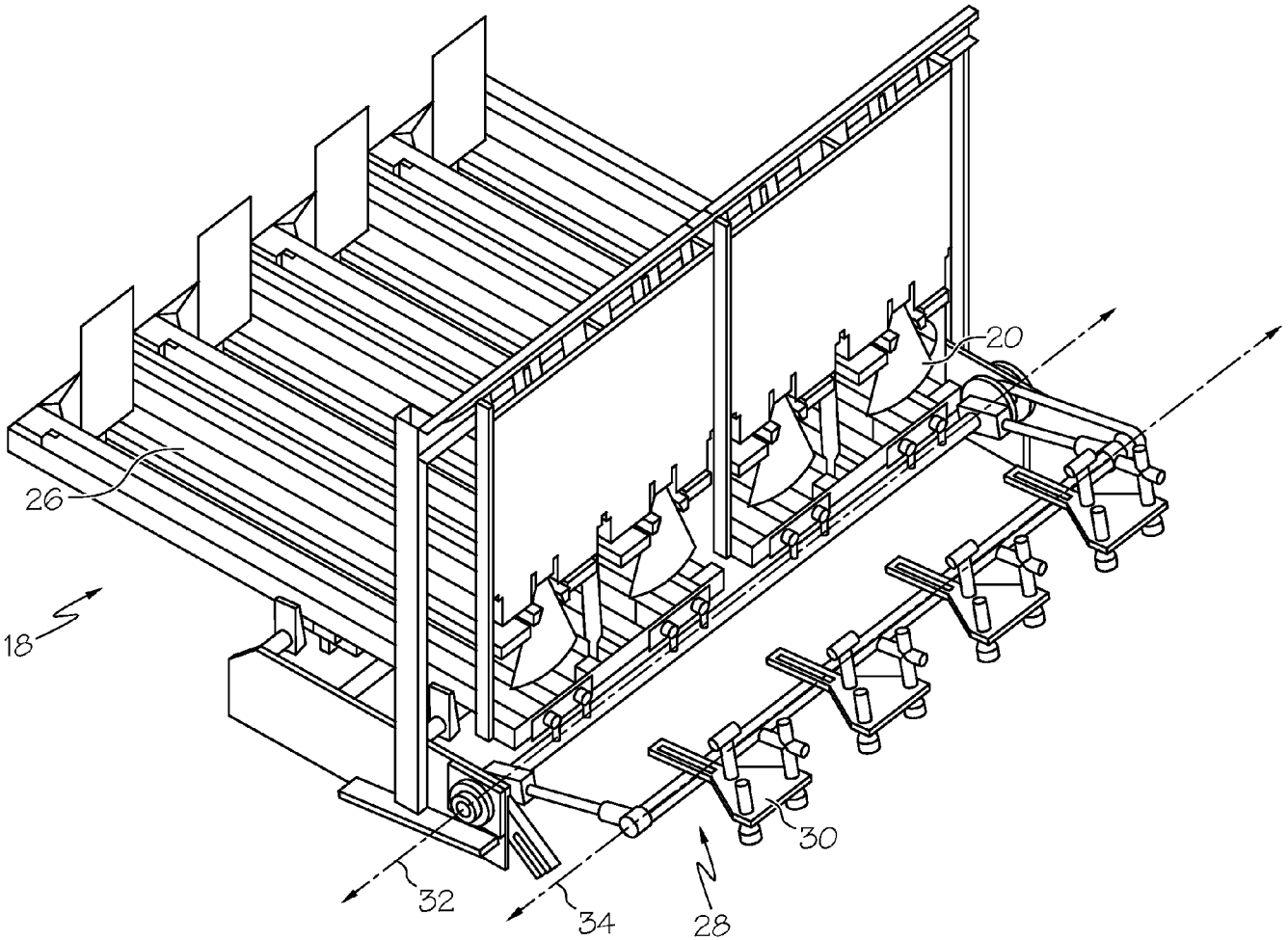
FIG. 3 shows a carton magazine.

Shown in FIG. 3 is a magazine 18 used to hold cartons 20 and load them onto the shuttle bed 12 prior to forming. The magazine 18 is mounted above the first portion 24 of the frame 22 such that cartons 20 are deposited on the shuttle bed 12 at the carton drop location 42 (FIG. 2C). In some embodiments, the magazine 18 comprises a rack 26 (or plurality of racks) in which the cartons 20 are deposited. The rack 26 can be placed at an incline relative to the shuttle bed 12. The magazine 18 further comprises a carton loader 28 which picks the cartons 20 (generally one at a time) from the rack 26 and places the cartons 20 on the shuttle bed 12. In FIG. 3, the carton loader 28 is shown in the carton drop position, for example, immediately after it has deposited the carton 20 onto the shuttle bed 12.

In some embodiments, the carton loader 28 uses a vacuum source (not shown) to carry carton 20 from the rack to the shuttle bed 12. In this way, a vacuum can be created as the carton loader 28 comes into contact with carton 20, thereby creating suction between the carton loader 28 and the carton 20. Moreover, as the carton 20 is placed on the shuttle bed 12, the vacuum is terminated and the carton 20 is released onto the shuttle bed 12. The cartons 20 can also be moved from the magazine 18 to the shuttle bed 12 by other methods, as will be appreciated by the skilled artisan.

Returning to FIG. 3, in some embodiments, the carton loader 28 has a loading head 30, a first axis 32, and a second axis 34. The loading head(s) 30 rotate(s) about the second axis 34 and revolves about the first axis 32. For example, as the loading head(s) 30 (and second axis 34) move toward the rack 26 to pick up a carton 20, the loading head(s) 30 are also rotating about second axis 34. Moreover, the direction of revolution of the second axis 34 about the first axis 32 is opposite the direction of rotation of the loading head 30 about the second axis 34. In other words, as loading head 30 is revolving about axis 32 in a counter-clockwise direction, loading head 30 is rotating about axis 34 in a clockwise direction.

Returning to FIG. 1, the forming assembly 10 further comprises a shuttle 40. The shuttle 40 slides along the shuttle bed 12 to move the carton 20 from the carton drop location 42 to the carton forming station 44. As shown for example in FIG. 5A, the shuttle 40 comprises a pusher arm 46, a pusher arm locking plate 48, and a pusher 50.

Figure 5C:
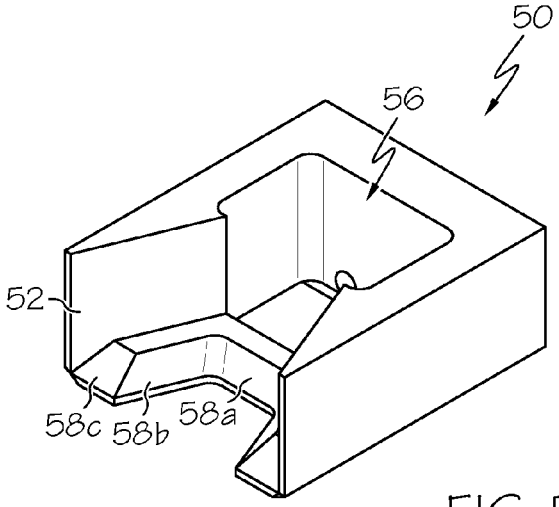

In some embodiments, the pusher 50 is configured to contact the carton 20 in a particular fashion, to assist in maintaining the directional stability of the carton 20 along the shuttle bed 12. For example, where the carton blank 20*a* is generally triangular in shape (as shown in FIG. 4A), the pusher 50 can be configured to contact the carton blank 20*a* along two edges 60 of the carton blank 20*a*. By way of example, and in turning to FIGS. 5B and 5C, the pusher 50 comprises a first pushing surface 52 and a second pushing surface 54. The first and second pushing surfaces 52, 54 are separated by an angle $\alpha$. In some embodiments, angle $\alpha$ matches the angle $\beta$ separating the edges 60 of the carton blank 20*a*, which are pushed upon by the pusher 50 (FIG. 4A). For example, angle $\alpha$ is equal to angle $\beta$.

In some embodiments, for example where the carton has more than three major edges, the pusher 50 can comprise any desired number of pushing surfaces, for example 1, 2, 3, 4, 5, or more. The term "major" as used herein refers to the surfaces, sides, tabs, edges (and the like) of the carton 20 that define the finished shape of the formed carton 20*b*. Contrastingly, the term "minor" is used herein to describe the surfaces, sides, tabs, edges (and the like) that are fastened to major surfaces, sides, tabs, or edges upon formation of the formed carton 20*b*. For example, as shown in FIG. 4A, tabs 70, 72, and 74 are major tabs while tabs 76, 78, and 80 are minor tabs. More particularly, the carton 20 shown in FIG. 4A has a first major tab 70, a second major tab 72, and a third major tab 74. The carton 20 shown in FIG. 4A further has a first minor tab 76, a second minor tab 78, and a third minor tab 80.

In addition to the foregoing, although the pushing surfaces 52, 54, are shown perpendicular to the shuttle bed 12, the pushing surfaces 52, 54 can also be disposed at any desired angle relative to the shuttle bed 12. Furthermore, where the shape of the carton 20 and/or carton blank 20*a* is of a shape that is not triangular, the pusher 50 can be designed to match the geometry of the particular carton blank 20*a*.

In some embodiments, the pusher 50 has a pusher cavity 56. The pusher cavity 56 permits the desired portion of the carton 20 to reside therein as the first and second pushing surfaces 52, 54, contact respective edges 60 of the carton 20. This, in turn, permits a region of contact between the edges 60 of the carton 20 and the pushing surfaces 52, 54.

The pusher 50 further comprises at least one lead-in surface 58. Lead-in surface 58*a* initially contacts minor tab 76 as the shuttle 40 advances along the shuttle bed 12. Turning to FIG. 2C, as the shuttle 40 moves from a retracted position 62 towards the carton 20, the minor tab 76 is contacted at least by lead-in surface 58*a*, forcing the minor tab into the pusher cavity 56. Lead-in surfaces 58*b* and 58*c* further direct the carton 20 into the proper orientation with the pusher 50. The pusher 50 thereafter moves the carton 20 from the carton drop location 42 along shuttle bed 12 to carton forming station 44.

In some embodiments, the carton 20 is glued together. Where the carton 20 is glued together, the carton 20 need not have locking windows 170*a*, 170*b* (which are discussed in greater detail, below). Moreover, where the carton 20 is glued together, the carton 20 need not have latches 172 (which are also discussed in greater detail, below). In embodiments where the carton 20 is glued together, the glue can be applied to the carton 20 prior to the carton 20 arriving at the carton forming station 44. More particularly, the glue can be applied to the carton 20 as the carton 20 moves along the support guides 36, for example as shown in FIG. 6A. In some embodiments, the glue (not shown) is applied to the major tabs, for example, the first major tab 70 and the second major tab 72, along areas of the major tabs (e.g., 70, 72) where the minor tabs (e.g., first minor tab 76, second minor tab 78, and third minor tab 80) will contact the major tabs. In some embodiments, for example where the minor tabs are disposed interiorly to the major tabs, the glue is applied to the major tabs. In contrast, in some embodiments, where the minor tab or tabs are applied exteriorly to the major tab or tabs, glue is applied to the minor tabs. It will be appreciated, however, that for a particular carton 20, the carton 20 can include one or more minor tabs disposed interiorly to one or more of the major tabs and one or more of the minor tabs exteriorly to one or more of the major tabs. In other words, not all of the minor/major tabs need have the same interior/exterior configuration.

In traveling from the carton drop location 42 to the carton forming station 44, the carton 20 moves along support guides 36, arriving at forming cavity 16. In some embodiments, for example as shown in FIGS. 7 and 8, the support guides 36 comprise a support guide first surface 38 along which the carton 20 slides as the carton 20 is moved by the pusher 50. In some embodiments, the support guides 36 further comprise a support guide second surface 39. As shown, for example, in FIGS. 7 and 8, the support guide second surface 39 is orthogonal to the support guide first surface 38. However, the support guide first surface 38 can also be disposed at any suitable angle $\gamma$ relative to the support guide second surface 39.

In some embodiments, one or more of the support guides 36 comprises a channel 64. In some embodiments, the channel 64 extends along the length of the support guide first surface 38. The channel 64 can be formed, for example, by cutting or milling away material from the support guide 36.

In some embodiments, the support guide 36 is used in combination with a rail 66. FIG. 9 shows the right-hand rail 66 while FIG. 10 shows the left-hand rail 66. In some embodiments, the right and left-hand rails 66 are mirror images of each other. Moreover, in some embodiments, the rail 66 comprises a contact surface 68 and a recess 69.

In some embodiments, the rail 66 is mounted to the support guide 36, and in particular, the rail 66 is mounted adjacent to the support guide second surface 39, for example as shown in FIGS. 6A-6C. As shown in FIGS. 9 and 10, the rail 66 has at least one adjustment hole 82. The adjustment hole(s) 82 permits the height and/or angle of the rail 82 to be adjusted with respect to the channel 64. In this regard, the contact surface 68 can be set in any desirable configuration with respect to the channel 64 and the support guide first surface 38. Moreover, in some embodiments, the rail 66 is positioned such that the contact surface 68 is above the plane of the support guide first surface 38. In some embodiments, the rail 66 is positioned such that the contact surface 68 is coplanar with the support guide first surface 38. Moreover, in some embodiments, the rail 66 is positioned such that the contact surface 68 of the rail 66 is below the plane of the support guide first surface 38.

As the carton 20 is pushed along the length of the rail 66 and support guides 36 by pusher 50, a portion of the carton 20 is contacted by contact surface 68 of rail 66. Moreover, a portion of the carton edge 60 is contacted by the support guide second surface 39, thereby keeping the carton 20 centered between opposing support guides 36 as the carton 20 is pushed. In some embodiments, the rail 66 applies pressure to one side of the carton 20 while the support guide first surface 38 applies pressure to the opposite side of the carton 20. In this way, the carton 20 is pinched between the contact surface 68 and the support guide first surface 38 but still permitted to slide along the length of the support guide 36. Also, in some embodiments, the width of the channel 64 ($w_2$) is greater than the width of the rail 66 ($w_1$) (FIGS. 7 and 9). Consequently, the force exerted on one side of the carton 20 by the rail 66 is offset from the force exerted on the other side of the carton 20 by the support guide first surface 38. As noted above, the rail 66 can be adjusted to apply the desired amount of force on the carton 20 as the carton 20 moves along the support guide 36. The width of the channel 64 ($w_2$) and the width of the rail 66 ($w_1$) can be sized according to the particular application. In this regard, it should first be noted that the carton 20 can be comprised of any desirable material, for example, stiff paper, plastic, or cardboard, and can comprise multiple layers of one or more materials, and/or coatings. The carton 20 may be formed or treated as disclosed in U.S. Pat. No. 6,946,082 to Watkins and U.S. Pat. No. 7,525,075 to Watkins and Dohanick, which are herein incorporated by reference. Returning to the sizing of the rail and channel widths, $w_1$ and $w_2$, respectively, it will be appreciated that where the carton material is relatively stiff, the channel 64 can be wider as compared to a carton comprising a material that is relatively less stiff or is thinner. Moreover, where the carton material is relatively stiffer, the rail 66 can be adjusted to provide the proper force on the carton 20. In sum, the width of the rail 66, the width of the channel 64, and the height of the rail contact surface 68 above or below the support guide first surface 38, can be configured in light of the material(s) and shape of the carton 20.

As the shuttle 40 moves to its extended position 63, for example as shown in FIG. 1, it begins to decelerate. The friction generated by pinching the carton 20 between the rail 66 and the support guide first surface 38 prevents the carton 20 from drifting away from the pusher 50. Nonetheless, as the shuttle 40 comes to a stop at its extended position 63, the carton 20 maintains some momentum as it arrives at the carton forming station 44. To prevent the carton 20 from rebounding out of the carton forming station, in some embodiments, the carton 20 is further oriented by way of recess 69. (FIG. 38). Turning to FIG. 11A, a cross section of an embodiment of the assembled rail 66 and support guide 36 is shown. Also included in FIG. 11A is a carton 20 just prior to its arrival at the carton forming station 44. Prior to the carton's arrival at the carton forming station 44, the carton 20 has portions of the first major tab 70 and second minor tab 78 that are bent down by the rail 66. When the carton 20 reaches carton forming station 44, the portions of the first major tab 70 and second minor tab 78, which were previously bent down by rail 66, snap upwardly into recess 69, as shown in FIG. 11B. The previously bent portions of the first major tab 70 and second minor tab 78 snap upwardly into recess 69 just before the shuttle 40 reaches its extended position 63. And, after the tabs 70, 78, and/or 74, 80 are allowed to snap upwardly into recess(es) 69, the carton 20 is held in place and is prevented from rebounding out of carton forming station 44 towards the pusher 50.

Once the carton blank 20*a* has reached the forming station 44, it is ready to be formed into formed carton 20*b*. The carton blank 20*a* is formed into formed carton 20*b* by way of forming cavity 16 and forming head 14. Returning to FIG. 1, the carton 20 is formed as forming head 14 moves downwardly in the negative y direction, pushing the carton 20 through forming cavity 16.

As shown in FIGS. 12A, 12B, 13, 14, and 15, in some embodiments, the forming head 14 comprises a plurality of forming head side plates 102 and a forming head back plate 104. The forming head side plates 102 and forming head back plate 104 are assembled together so that the outer perimeter of the forming head base 106 matches the interior perimeter 108 of the carton 20. Moreover, in some embodiments, the carton blank 20*a* has scored or perforated regions 110 along which the carton 20 is bent.

Returning to FIGS. 6A-6C, in some embodiments, the forming cavity 16 comprises a plurality of cavity side plates, including a first cavity side plate 120, a second cavity side plate 122, and a cavity back plate 124. The first cavity side plate 120 is shown in greater detail in FIG. 16, while the second cavity side plate 122 is shown in greater detail in FIG. 17, and the cavity back plate 124 is shown in greater detail in FIG. 18. The first cavity side plate 120 is configured to contact the first major tab 70, thereby bending the first major tab 70 upwardly to the position shown in FIG. 4B. The second cavity side plate 122 is configured to contact the third major tab 74, thereby bending the third major tab 74 upwardly to the position shown in FIG. 4B. Finally, the cavity back plate 124 is configured to contact the second major tab 72, thereby bending the second major tab 72 upwardly to the position shown in FIG. 4B.

Taking the first cavity side plate 120 in greater detail, in some embodiments, for example as shown in FIG. 16, the first cavity side plate 120 comprises a facing surface 126, a forming surface 128, and an initiating surface 130. In some embodiments, the first cavity side plate 120 further comprises a raised surface 132. In some embodiments, the facing surface 126 of the first cavity side plate 120 is perpendicular to the initiating surface 130 of the first cavity side plate 120.

The second cavity side plate 122, for example as shown FIG. 17 comprises a facing surface 136, a forming surface 138, and an initiating surface 140. And, the cavity back plate 124, as shown for example in FIG. 18, comprises at least one facing surface 146, a forming surface 148, and an initiating surface 150. In some embodiments, the facing surface 136 of the second cavity side plate 122 is perpendicular to the initiating surface 140 of the second cavity side plate 122.

In some embodiments, the first cavity side plate 120 is separated by an angle θ with respect to the second cavity side plate 122 (FIG. 6C). In some embodiments, angle θ is less than 90 degrees. Moreover, in some embodiments, θ is between 25 and 70 degrees, and in some embodiments, is 45 degrees.

The forming cavity 16 further comprises a first latching guide 200, a second latching guide 202, and a third latching guide 204. The first latching guide 200 is shown in greater detail in FIG. 22, the second latching guide 202 in FIG. 23, and the third latching guide 204 in FIG. 24. In some embodiments, the forming cavity 16 further comprises at least one minor tab guide 206 and at least one minor folding member 208. The minor tab guides 206*a* and 206*b* are shown, for example, in FIGS. 25 and 26, while an embodiment of the minor folding member 208 is shown in 27A, and 27B. Finally, in some embodiments, the forming cavity 16 comprises a roller guide 210, shown for example in FIG. 28.

The roller guide 210 works in conjunction with roller 212 of forming head 14. The roller 212 is shown in greater detail in FIG. 29. More specifically, as the forming head 14 moves downwardly in the negative y direction through the forming cavity 16, the roller 212 contacts the guide surface 214 (FIG. 28). For example, as shown in FIG. 28, the guide surface 214 has a particular profile that successively forces the roller 212 toward the front 112 of the forming head. Via the internal mechanism of the forming head 14, the forward movement of the roller 212 actuates the rear fingers 180 and front finger 182, as is discussed in greater detail below. Moreover, in some embodiments, the roller guide 210 is disposed to protrude through the cut-out 152 of the cavity back plate 124.

Returning to the forming process, after the carton 20 has arrived at the forming cavity 16, the rear carton edge 61 of the carton 20 contacts rear stops 160 and 162, which are shown in greater detail in FIGS. 32 and 33, respectively. Turning to FIGS. 32 and 33, in some embodiments, the rear stops 160, 162 each comprise a stop surface 164 and a lead-in surface 166. After being pushed to the carton forming station 44 by pusher 50, the carton 20 is prevented from moving in the positive x direction (FIG. 1) by rear stops 160, 162, and is prevented from moving in the negative x direction by recesses 69 in rails 66. Consequently, the carton 20 is located in the carton forming station 44.

As the forming process begins and the forming head 14 begins moving downwardly in the negative y direction (FIG. 1), the rear carton edge 61 of the carton 20 contacts the stop surface 164 of the rear stops 160, 162. The forming head 14 then moves downwardly in the negative y direction so that the forming head base 106 contacts the top surface 90 of the carton 20 adjacent to the scored or perforated regions 110 of the carton 20.

In certain embodiments, the forming head 14, in combination with the forming cavity 16, will be configured to assemble cartons 20 having locking windows 170 and corresponding latches 172 (FIG. 4A). As shown in FIG. 4B, the latches 172 are inserted into the locking windows 170 to prevent the carton 20 from falling apart after assembly. The carton 20 can also comprise other configurations; for example, the carton 20 can be assembled using glue or any other suitable fastener. In particular, the minor tabs 76, 78, 80 can be glued to the major tabs 70, 72, 74 and the major and minor tabs need not have locking windows 170 or latches 172. Instead, opposing surfaces will be fastened together.

Figure 19A:
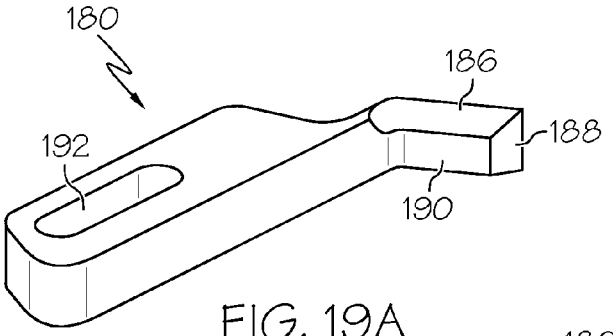
Figure 19B:
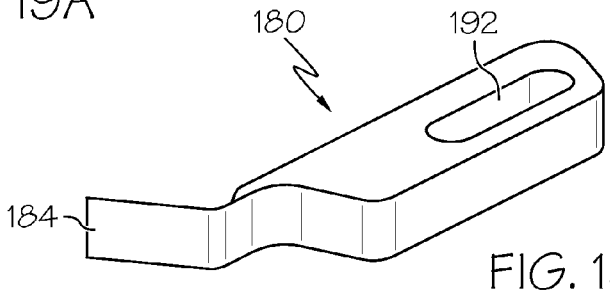
Figure 20A:
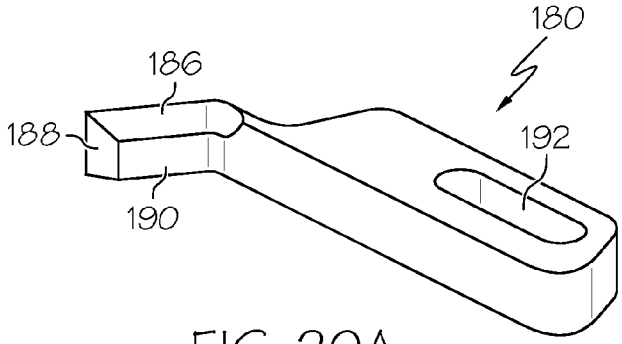
Figure 20B:
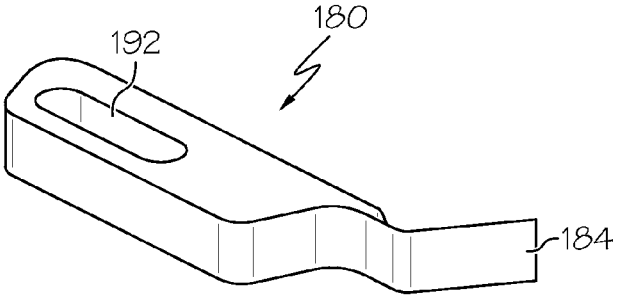

Returning to the embodiment of the carton 20 shown in FIGS. 4A and 4B having locking windows 170 and latches 172, the forming head 14 can comprise a plurality of fingers, including rear fingers 180 and front finger 182. The rear fingers 180 are shown in greater detail in FIGS. 19A, 19B, 20A, and 20B. Turning to FIGS. 19A, 19B, the rear finger 180 shown therein comprises a window opening surface 184, a top lead-in surface 186, a side lead-in surface 188, and a contact surface 190.

The front finger 182, as shown in FIGS. 21A and 21B, comprises at least one window opening surface 184, and, in some embodiments, comprises a first window opening surface 184*a* and a second window opening surface 184*b*. In some embodiments, the first window opening surface 184*a* is angled with respect to the second opening surface 184*b*. The front finger 182 further comprises at least one top lead-in surface 186, at least one side lead-in surface 188, and at least one contact surface 190.

In some embodiments, the forming cavity 16 forms the carton 20 as described below. Forming head 14 begins to move downwardly in the negative y direction, contacting carton blank 20*a*. Lead-in surfaces 166 of rear stop 160 begin folding the second major tab 72 about scored region 110*a*. Shortly thereafter, the second major tab 72 contacts rounded surface 220 of the first and second latching guides 200, 202. This, in turn, continues folding the second major tab 72 about scored region 110*a*. As the second major tab 72 is folded, the opening surface 184 of rear fingers 180 comes into contact with the carton material of the locking windows 170*a*. Locking windows 170 comprise carton material that has been selectively cut through (prior to loading the cartons 20 in the magazine 18), for example, as shown in FIG. 4A. The opening surface 184 of rear fingers 180 pushes the rear locking windows 170*a* open. At this point in the forming process, the rear fingers 180 extend beyond the rear plane 216 defined by the forming head back plate 104. Next, the third minor tab 80 contacts the folding surface 230 of the minor tab guide 206*a*. As the carton 20 translates downwardly through the forming cavity 16, minor tab guide 206*a* bends the third minor tab 80 upwardly about scored or perforated region 110*b* of the third minor tab 80. Moreover, the second minor tab 78 contacts folding surface 230 of the minor tab guide 206*b*. As the carton 20 continues downwardly through the forming cavity 16, minor tab guide 206*b* bends the second minor tab 78 upwardly about scored or perforated region 110*c* of the second minor tab 78.

Next in the forming process, the first major tab 70 comes into contact with raised surface 132 of the first cavity side plate 120. This, in turn, forces the proximal portion 234 of the first major tab 70 upwardly about scored or perforated region 110*d*, while the distal portion 236 of the first major tab 70 remains in the same plane (or nearly in the same plane) as the carton base 94. In other words, the first major tab 70 is twisted along its length. Simultaneously, the proximal portion 234 of the first major tab 70 contacts the rounded surface 220 of the third latching guide 204. The rounded surface 220 of the third latching guide 204 thereby assists in folding the proximal portion 234 of the first major tab 70 about scored or perforated region 110*d*. In addition, and at the same time the proximal portion 234 of the first major tab 70 contacts the rounded surface 220 of the third latching guide 204, the first minor tab 76 contacts the engaging surface 240 on minor folding member 208 (FIGS. 27A and 27B). The engaging surface 240 of the minor folding member 208 folds the first minor tab 76 about scored or perforated region 110*e*. In some embodiments, the engaging surface 240 has a rounded profile to more gradually fold the first minor tab 76 about the scored or perforated region 110*e*.

As the first major tab 70 is folded about scored or perforated region 110*d*, surface 184*b*, followed by surface 184*a*, contact the front locking window 170*b* to open the locking window 170*b* in preparation for the insertion of front latch 172*b*.

Subsequently, as the carton 20 continues to move downwardly through the forming cavity 16, the third major tab 74 contacts initiating surface 140 of the second cavity side plate 122. Thereafter, the third major tab 74 contacts the forming surface 138 of the second cavity side plate 122, thereby folding the third major tab 74 about scored or perforated region 110*f*. At the same time that the third major tab 74 contacts the initiating surface 140 of the second cavity side plate 122, the distal portion 236 of the first major tab 70 begins to contact the initiating surface 130 of the first cavity side plate 120. Moreover, as the third major tab 74 contacts the forming surface 138 of the second cavity side plate 122, the distal portion 236 of the first major tab 70 contacts the forming surface 128 of the first cavity side plate 120. In addition to the foregoing, as the third major tab 74 contacts the initiating surface 140 and the distal portion 236 of the first major tab 70 contacts the initiating surface 130, the first minor tab 76 continues to fold about scored or perforated region 110*e*, until the first minor tab 76 is approximately perpendicular to the third major tab 74, being folded about scored or perforated region 110*e*. As the third major tab 74 transfers from initiating surface 140 to forming surface 138 of the second cavity side plate 122 and the distal portion 236 of the first major tab 70 transfers from initiating surface 130 to forming surface 128 of the first cavity side plate 120, the first minor tab 76 transitions from angled surface 242 to transfer surface 244 of the minor folding member 208. In some embodiments, the perforated region 110*e* is parallel to the angled surface 242, for example where angled surface 242 comprises a planar surface. Moreover, in some embodiments, the minor folding member comprises a reference surface 243. In some embodiments, the angled surface 242 is separated by angle δ with respect to reference surface 243. In some embodiments, angle δ is between 120 and 160 degrees, and in some embodiments is between 140 and 150 degrees. Furthermore, in some embodiments, the angled surface 242 is perpendicular to the facing surface 136 of the second cavity side plate 122 and the initiating surface 140 of the second cavity side plate 140.

As the third major tab 74 continues its transition along forming surface 138 and the distal portion 236 of the first major tab 70 continues its transition along forming surface 128, the first minor tab 76 is transferred from the transfer surface 244 of the minor folding member 208 to the rounded surface 220 of the third latching guide 204.

Turning to the FIG. 24, in some embodiments, the third latching guide 204 further comprises a chamfer or round 246. In some embodiments, the chamfer or round 246 extends along at least a portion of both the rounded surface 220 and the straight portion 222 of the third latching guide 204. As the shown for example in FIG. 24, the third latching guide 204 has a round 246 extending along both the rounded surface 220 and along a portion of the straight portion 222.

As the first minor tab 76 transitions from contacting the rounded surface 220 to contacting the straight portion 222 of the third latching guide 204, it comes into contact with the top lead-in surface 186 and the side lead-in surface 188 of the front finger 182 (FIGS. 21A and 21B). At this point, the front locking window 170*b* is still being held open by opening surfaces 184*a* and/or 184*b* of the front finger 182. As the front finger 182 holds open the front locking window 170*b* with opening surfaces 184*a* and 184*b*, the front latch 172*b* is directed along contract surface 190 of the front finger 182 as the forming head 14 continues to move the carton 20 downwardly through the forming cavity 16. Moreover, the first minor tab 76 (and latch 172*b*) are directed along top lead-in surface 186, side lead-in surface 188, and contact surface 190 of the front finger 182 by the third latching guide 204.

At the same time that the first minor tab 76 is being directed along top lead-in surface 186, side lead-in surface 188, and contact surface 190 of the front finger 182, the second minor tab 78 transitions from folding surface 230 to transfer surface 232 of the minor tab guide 206*b* (FIG. 26). Concurrently therewith, the third minor tab 80 transitions from folding surface 230 to transfer surface 232 of the minor tab guide 206*a* (FIG. 25). Thereafter, as the distal portion 236 of the first major tab 70 and the third major tab continue to be folded about scored or perforated regions 110*d*, 110*f*, respectively, the second minor tab 78 transitions from transfer surface 232 of the minor tab guide 206*b* to the rounded surface 220 of the second latching guide 202 and the third minor tab 80 transitions from transfer surface 232 of the minor tab guide 206*a* to the rounded surface 220 of the first latching guide 200. At this point, the second minor tab 78 is positioned between the second latching guide 202 and the first outer window frame 174 of the second major tab 72. Moreover, the third minor tab 80 is positioned between the latching guide 200 and the second outer window frame 176 of the second major tab 72. The chamfer or round 246 of the second latching guide 202 allows the second minor tab 78 to pass between the second latching guide 202 and the first outer window frame 174. The chamfer or round 246 of the first latching guide 200 allows the third minor tab 80 to pass between the first latching guide 200 and the second outer window frame 176. As the rear locking windows 170*a* are being held open by opening surfaces 184 of rear fingers 180, the second minor tab 78 and third minor tab 80 are allowed to pass on the under surface 92 of the first outer window frame 174 and second outer window frame 176, respectively. Meanwhile, the second minor tab 78 and the third minor tab 80 come into contact with top lead-in surface 186 and side lead-in surface 188 of rear fingers 180. Thereafter, as the first major tab 70 and third major tab 74 continue to fold about scored or perforated regions 110*d*, 110*f*, respectively, each of the second minor tab 78 and third minor tab 80 come into contact with a respective contact surface 190 of the respective rear finger 180. At this point, in some embodiments, the first major tab 70 is perpendicular to the carton base 94 (FIG. 4B) and the first major tab 70 has transitioned to the facing surface 126 of the first cavity side plate 120. Also as this point, in some embodiments, the third major tab 74 is perpendicular to the carton base 94 and the third major tab 74 has transitioned to the facing surface 136 of the second cavity side plate 122. And, the second major tab 72 has transitioned to the facing surface 146 of the cavity back plate 124. In some embodiments, therefore, the second major tab 72 is perpendicular to the carton base 94.

At this point, the carton 20 is nearly formed. However, in accordance with an embodiment having locking windows 170 and latches 172, the latches 172 still need to be positively locked within the locking windows 170. To facilitate locking of the latches 172 in the locking windows 170, the roller guide 210 has a guide surface 214. The roller guide 210 further comprises a pick-up surface 226, where the roller 212 initially contacts the roller guide 210 and begins moving the fingers 180, 182. The roller 212 rolls along the guide surface 214, moving the roller axis 224 toward the front 112 of the forming head 14. As the roller 212 continues along guide surface 214, the front finger 182 is rotated inwardly toward the center forming head 14 about its pivot hole 192. Simultaneously the rear fingers 180 move inwardly toward the center of the forming head 14 about lever arm pivot axis 260. In some embodiments, for example as shown in FIGS. 19A, 19B, 20A, and 20B, the pivot holes 192 are oblong to permit adjustment of the fingers 180, 182 during set-up of the forming assembly 10.

To fully lock the latches 172 within the locking windows 170, the fingers 180, 182 pivot inwardly, forcing the latches 172*a* and 172*b* inwardly with surfaces 188 and 190 of fingers 180 and 182. As the roller 212 reaches the lock surface 228, the fingers 180, 182 have moved fully inwardly. At this point, the latches 172*a* are latched to the first and second outer window frames, 174, 176 and the latch 172*b* is latched to the third outer window frame 178. The formed carton 20*b* is consequently assembled.

As shown in FIGS. 35-37, the front finger 182 is actuated via push rod 256 which extends through push rod guide 262. The position of push rod 256 can be adjusted by way of push rod adjustment 258, which, in some embodiments, comprises a bolt that is threaded into lever arm 268. As the lever arm 268 rotates about lever arm pivot axis 260, the push rod 256 is displaced toward the front 112 of the forming head 14, thus actuating rocker 264 about rocker pivot axis 266. Actuation of rocker 264 necessarily rotates the front finger 182 to lock the latch 172*b*.

Now, the formed carton 20*b* needs to be removed from the forming cavity 16 and forming head 14. As shown for example in FIGS. 34 and 37, the formed carton 20*b* (FIG. 4B) is ejected via ejector rod 250 and ejector plate 252. The ejector rod 250 pushes the ejector plate 252, which, in turn, pushes the top surface 90 of the carton 20*b* away from the forming head 14. Additionally, the ejector plate guide rod 254 guides the ejector plate 252 as the ejector plate 252 moves between the retracted and extended position. The carton 20*b* is thereby formed.

By way of review, FIG. 31 provides a flow chart of the above-described carton loading and forming process. The process is started by cycling the machine at step 300. Thereafter, the tray (or carton 20) is taken from the magazine 18 at step 310 and deposited on the shuttle bed at step 320. The forming process 330 subsequently takes place, and the carton is formed. The forming process of the carton is complete at step 340 and the cycle can repeat as desired.

As noted previously, it will be appreciated that the scope of the invention is not meant to be limited to the particular embodiments discussed herein. For example, the forming assembly need not include fingers that open locking windows and latch latches in the locking windows, in embodiments that are held together, for example, by glue or another suitable fastener. Moreover, it will be appreciated that the minor tab(s) can be fastened, for example by gluing, to the top surface 90 of the major tabs by adjusting the relationship of the forming members (e.g., minor folding member 208, first cavity side plate 120). In this way, the minor tabs will be disposed on the inside of the major tabs after the carton has been formed.

What is claimed is:

1. A carton forming assembly for forming a carton having a plurality of sides, wherein at least two of the sides are separated by an angle less than 90 degrees, the forming assembly comprising:

a forming head, a forming cavity, and at least one minor folding member;

the forming cavity comprising a plurality of cavity side plates, at least two of the plurality of cavity side plates separated by an angle that is less than 90 degrees;

at least one of the plurality of cavity side plates having a forming surface and a raised surface, the raised surface extending along a portion of the forming surface; and the at least one minor folding member having an angled surface and a reference surface, the angled surface being adjacent to the reference surface, the angled surface forming an angle of between 120 and 160 degrees with respect to reference surface.

2. The carton forming assembly of claim 1, wherein the forming surface is a curved surface.

3. The carton forming assembly of claim 2, wherein the plurality of cavity side plates comprises two cavity side plates.

4. The carton forming assembly of claim 3, wherein the two cavity side plates are separated by an angle of between 25 and 70 degrees.

5. The carton forming assembly of claim 4 further comprising a back plate.

6. The carton forming assembly of claim 1, wherein at least one of the cavity side plates comprises an initiating surface and a facing surface, the initiating surface and the facing surface being perpendicular to one another and to the angled surface of the at least one minor folding member.

* * * * *